US010381747B2

(12) United States Patent
Chien et al.

(10) Patent No.: US 10,381,747 B2
(45) Date of Patent: Aug. 13, 2019

(54) MULTIPLE POLARIZED ANTENNA

(71) Applicant: GEMTEK TECHNOLOGY CO., LTD., Hsinchu (TW)

(72) Inventors: Hsiao-Ching Chien, Hsinchu (TW); Hsu-Sheng Wu, Hsinchu (TW); Chung-Kai Yang, Hsinchu (TW)

(73) Assignee: GEMTEK TECHNOLOGY CO., LTD., Hsinchu (TW)

( * ) Notice: Subject to any disclaimer, the term of this patent is extended or adjusted under 35 U.S.C. 154(b) by 11 days.

(21) Appl. No.: 15/157,351

(22) Filed: May 17, 2016

(65) Prior Publication Data

US 2017/0125919 A1 May 4, 2017

Related U.S. Application Data

(60) Provisional application No. 62/247,377, filed on Oct. 28, 2015.

(51) Int. Cl.
*H01Q 21/24* (2006.01)
*H01Q 9/04* (2006.01)

(52) U.S. Cl.
CPC ..... *H01Q 21/24* (2013.01); *H01Q 9/045* (2013.01); *H01Q 9/0414* (2013.01); *H01Q 9/0421* (2013.01); *H01Q 9/0464* (2013.01)

(58) Field of Classification Search
CPC .. H01Q 9/0407; H01Q 9/0414; H01Q 9/0421; H01Q 9/0428; H01Q 9/0435; H01Q 9/045; H01Q 9/0457; H01Q 21/24
See application file for complete search history.

(56) References Cited

U.S. PATENT DOCUMENTS 5,880,694 A * 3/1999 Wang ..... H01Q 9/0414 343/700 MS
2006/0007044 A1* 1/2006 Crouch ..... H01Q 9/0435 343/700 MS
2006/0097921 A1* 5/2006 Luk ..... H01Q 9/36 343/700 MS
2009/0102723 A1* 4/2009 Mateychuk ..... H01Q 5/40 343/700 MS
2009/0140930 A1* 6/2009 Tatarnikov ..... H01Q 9/0414 343/700 MS
2015/0155630 A1* 6/2015 Jiang ..... H01Q 9/36 343/700 MS
2015/0333407 A1* 11/2015 Yamagajo ..... H01Q 9/0414 343/905

* cited by examiner

*Primary Examiner* — Robert Karacsony
(74) *Attorney, Agent, or Firm* — Maschoff Brennan

(57) ABSTRACT

A polarized antenna includes a load board, a first radiation plate, M pieces of feeding part and N pieces of grounded part. The load board includes a conductive layer, and the first radiation plate is located above the load board and has a first resonance gap with the conductive layer. The M pieces of feeding part are located under the first radiation plate and are insulated from the conductive layer, and at least a part of each feeding part is covered by the first radiation plate and is used to have signal transmission with the first radiation plate. M is a positive integer larger than 2. The N pieces of grounded part are located on the load board and electrically connected to the conductive layer, and N is a positive integer larger than 1.

15 Claims, 20 Drawing Sheets

MULTIPLE POLARIZED ANTENNA

CROSS-REFERENCE TO RELATED APPLICATIONS

This non-provisional application claims priority under 35 U.S.C. § 119(a) on Patent Application No. 62/247,377 filed in the United States on Oct. 28, 2015, the entire contents of which are hereby incorporated by reference.

BACKGROUND

Technical Field

The disclosure relates to a polarized antenna, more particularly to a polarized antenna including more than two feeding parts.

Related Art

Electromagnetic waves radiated from an antenna consist of electric and magnetic fields, and the direction of the electric field is defined as the direction of polarization. An antenna having a different direction of polarization can receive and transmit electromagnetic waves in the same direction. If the direction of polarization of an antenna differs from the direction of polarization of an electromagnetic wave received by the antenna, a polarization loss will occurs, so the signal energy obtained by the antenna will smaller than the inherent signal energy of the electromagnetic wave.

To reduce the occurrence of a polarization loss, various types of antenna elements have been designed to receive electromagnetic waves with a variety of directions of electric field. However, electronic devices nowadays have been designed to be lighter and slimmer than before, so the space provided by such an electronic device to accommodate an antenna is limited. Therefore, it is difficult for an antenna to take care of having multi-directions of polarization and having good receiver insulation.

SUMMARY

The disclosure provides a polarized antenna to resolve the above problems.

According to one or more embodiments, a polarized antenna includes a load board, first radiation plate, M pieces of feeding part and N pieces of grounded part. The load board includes a conductive layer. The first radiation plate is located above the load board, and the first radiation plate and the conductive layer have a first resonance gap therebetween. The M pieces of feeding part are located under the first radiation plate and insulated from the conductive layer. At least a part of each of the feeding parts is covered by and located under the first radiation plate and is applicable to have signal transmission with the first radiation plate. M is a positive integer larger than 2. The N pieces of grounded part are located on the load board and electrically connected to the conductive layer. N is a positive integer larger than 1.

In the polarized antenna of the disclosure, more than two feeding parts are disposed to receive electromagnetic waves in a variety of directions of electric field, and more than two grounded parts are disposed to enhance the receiver insulation.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1A:
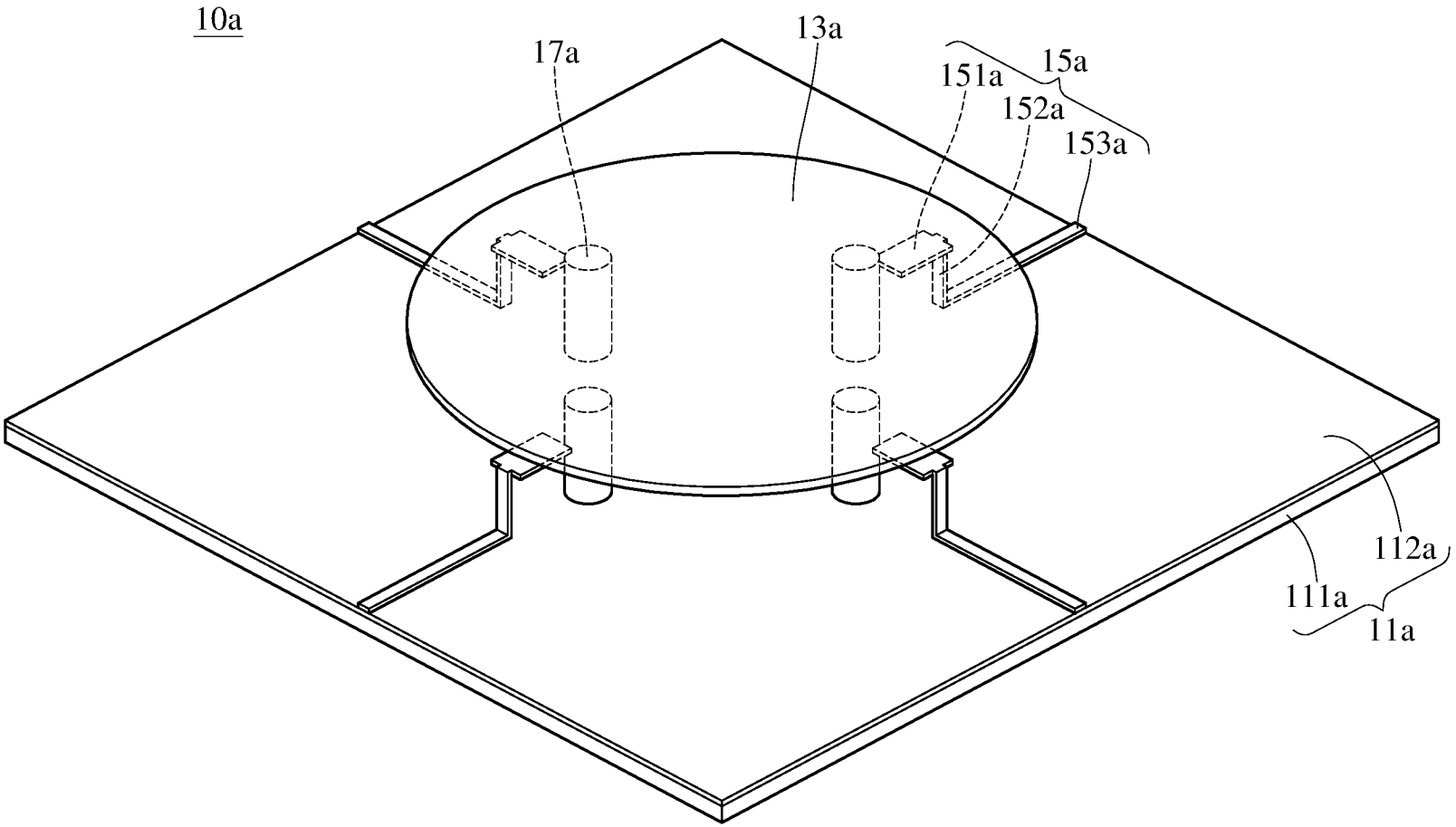
FIG. 1A is a perspective view of the first embodiment of a polarized antenna in the disclosure.
Figure 1B:
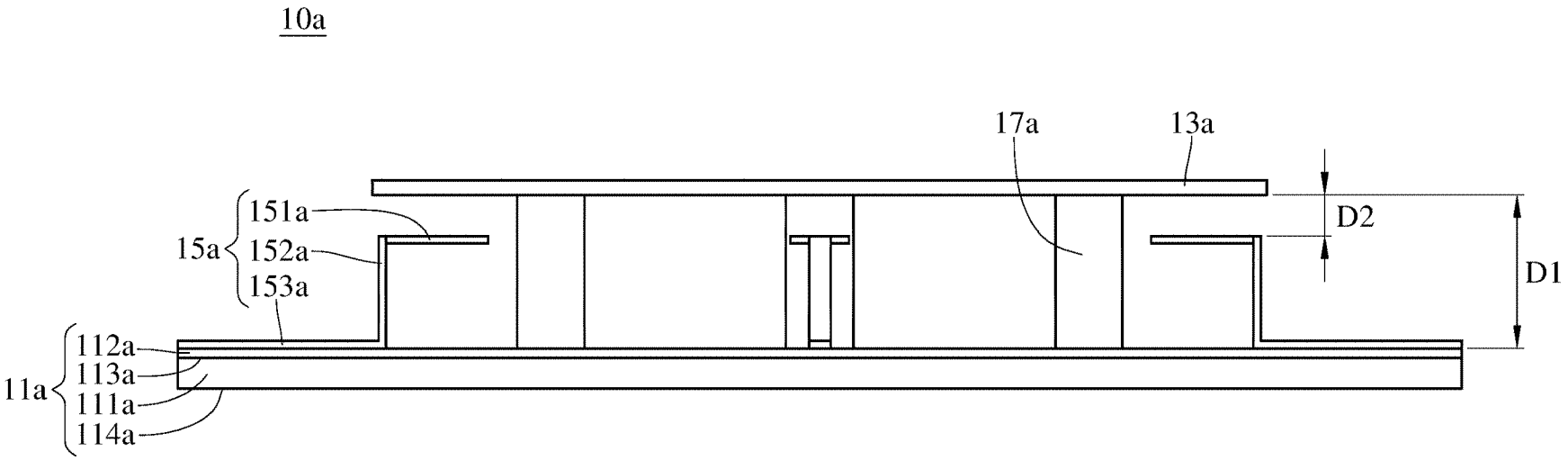
FIG. 1B is a side view of the first embodiment of a polarized antenna in the disclosure.
Figure 1C:
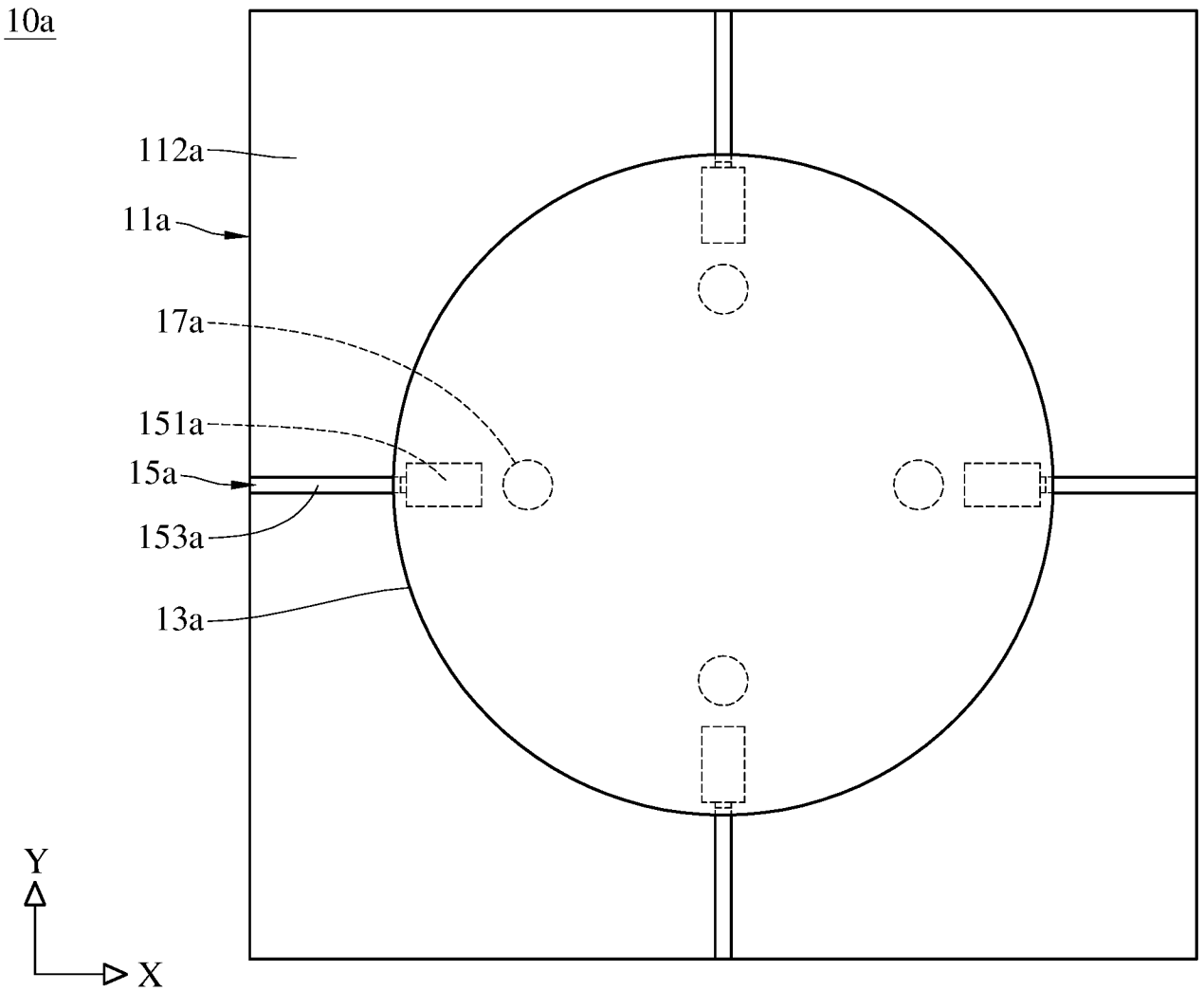
FIG. 1C is a top view of the first embodiment of a polarized antenna in the disclosure.

Please refer to FIG. 1A to FIG. 1C. FIG. 1A is a perspective view of the first embodiment of a polarized antenna in the disclosure, FIG. 1B is a side view of the first embodiment of a polarized antenna in the disclosure, and FIG. 1C is a top view of the first embodiment of a polarized antenna in the disclosure. In the figures, a polarized antenna 10*a* can be applied in a variety of communication devices, such as mobile communication devices, wireless communication devices, mobile computing devices and computer systems, or be applied in telecommunications equipment, network equipment, or peripheral equipment of computer or network.

The polarized antenna 10*a* includes a load board 11*a*, a first radiation plate 13*a*, four feeding parts 15*a* and four grounded parts 17*a*. The load board 11*a* includes a dielectric layer 111*a* and a conductive layer 112*a*. The dielectric layer 111*a* has a first surface 113*a* and a second surface 114*a* opposite to the first surface 113*a*, and they are an upper surface and a lower surface of the dielectric layer 111*a* and are parallel to each other. The conductive layer 112*a* is located on the first surface 113*a* of the dielectric layer 111*a*. The load board 11*a* is, for example, a case, inner structure or other suitable part of a communication device, for disposing the first radiation plate 13*a*, the feeding parts 15*a* and the grounded parts 17*a*. In this embodiment, the material of the load board 11*a* is, for example, a material of an insulating printed circuit board (PCB) substrate, plastic, a ceramic material or another suitable material, but this embodiment is not limited thereto.

The first radiation plate 13*a* is located above the load board 11*a* and is close to the first surface 113*a* of the dielectric layer 111*a*. There are the grounded parts 17*a* or other pillars of insulation material existing between the first radiation plate 13*a* and the conductive layer 112*a* so that the first radiation plate 13*a* and the conductive layer 112*a* have a first resonance gap D1 therebetween. In an embodiment, the first radiation plate 13*a* and the load board 11*a* are flat plate structures, and the normal vector of the first radiation plate 13*a* is substantially parallel to the normal vector of the load board 11*a*. For example, the width of the first resonance gap D1 is 0.05 times the wavelength corresponding to the resonant frequency band of the polarized antenna 10*a*, but this embodiment is not limited thereto.

The four feeding parts 15*a* are located under the first radiation plate 13*a* and on the conductive layer 112*a* of the load board 11*a*, and is insulated from the conductive layer 112*a*. In this embodiment, each of the feeding parts 15*a* includes a first conductor section 151*a*, a second conductor section 152*a* and a third conductor section 153*a*. The second conductor section 152*a* is located between the first conductor section 151*a* and the third conductor section 153*a*. The third conductor section 153*a* touches and is connected to the conductive layer 112*a* of the load board 11*a* and is insulated from the conductive layer 112*a*. The second conductor section 152*a* is substantially vertically or obliquely connected to an end of the third conductor section 153*a*, so the first conductor section 151*a* is farther from the conductive layer 112*a* of the load board 11*a* as compared to the third conductor section 153*a*. In other words, the first conductor section 151*a* is located between the first radiation plate 13*a* and the load board 11*a* and is separated from the load board 11*a*. The other end of the first conductor section 151*a* extends away from the third conductor section 153*a*. In the top view, the first conductor section 151*a* overlaps the first radiation plate 13*a*, and the first conductor section 151*a* is covered by and located under the first radiation plate 13*a*. In the side view, there is a coupling gap D2 between the second conductor section 152*a* and the first radiation plate 13*a*.

In the figures, the first conductor section 151*a* and the second conductor section 152*a* are covered by and located under the first radiation plate 13*a*, a part of the third conductor section 153*a* is also covered by and located under the first radiation plate 13*a*. In another embodiment, only a part of the first conductor section 151*a* is covered by and located under the first radiation plate 13*a*, but the second conductor section 152*a* and the third conductor section 153*a* are not covered by the first radiation plate 13*a*. In yet another embodiment, when the second conductor section 152*a* is obliquely disposed on the load board 11*a*, the first conductor section 151*a* and a part of the second conductor section 152*a* are covered by and located under the first radiation plate 13*a*, but the third conductor section 153*a* and the other part of the second conductor section 152*a* are not covered by the first radiation plate 13*a*. The disclosure is not limited to the above embodiments.

Based on the orientation of the figures, the four feeding parts 15*a* are sorted into upper, lower, left and right feeding parts 15*a*, respectively. The orientations of "upper", "lower", "left" and "right" are only for clear description rather than limiting the positions of the four feeding parts 15*a*. The left and right feeding parts 15*a* extend in a positive direction and a reverse direction along a first preset axis X, and the upper and lower feeding parts 15*a* extend in a positive direction and a reverse direction along a second preset axis Y. In this embodiment, the extension direction of the feeding part 15*a* is a direction in which the first conductor section 151*a* extends away from the third conductor section 153*a*. In this embodiment, the lower feeding part 15*a* extends in the positive direction along the second preset axis Y, the upper feeding part 15*a* extends in the reverse direction along the second preset axis Y; and likewise, the left feeding part 15*a* extends in the positive direction along the first preset axis X, and the right feeding part 15*a* extends in the reverse direction along the first preset axis X. In an embodiment, the first preset axis X is substantially vertical to the second preset axis Y, but the disclosure is not limited thereto.

The four grounded parts 17*a* are located on the load board 11*a*, and each of the grounded parts 17*a* is electrically connected to the conductive layer 11*a*. In this embodiment, the grounded parts 17*a* are connected to the first radiation plate 13*a*; in another embodiment, the grounded parts 17*a* are not connected to the first radiation plate 13*a*, and the top of the grounded parts 17*a* and the first radiation plate 13*a* have a gap therebetween. All of the four grounded parts 17*a* may not be connected to the first radiation plate 13*a*; for example, three or less than three of the four grounded parts 17*a* are connected to the first radiation plate 13*a*, and the rest of the four grounded parts 17*a* are not connected to the first radiation plate 13*a* and have a gap with the first radiation plate 13*a*; and the embodiment is not limited thereto.

Based on the orientation of the figure, the four grounded parts 17*a* are sorted to the upper, lower, left and right grounded parts 17*a*, respectively. Similarly, the orientations of "upper", "lower", "left" and "right" are only for clear description rather than limiting the positions of the four grounded parts 17*a*. The left and right grounded parts 17*a* are located on a virtual line between the left and right feeding parts 15*a* and between the left and right feeding parts 15*a*, and the left grounded part 17*a* is closer to the left feeding part 15*a* than the right grounded part 17*a*. The upper and lower grounded parts 17*a* are located on a virtual line between the upper and lower feeding parts 15*a* and between the upper and lower feeding parts 15*a*, and the upper grounded part 17*a* is closer to the upper feeding part 15*a* than the lower grounded part 17*a*.

In practice, the feeding parts 15*a* are electrically connected to a signal source, a signal processor or other suitable components through the third conductor section 153*a*. In the case of a signal processor, the feeding parts 15*a* receives electromagnetic waves from the first radiation plate 13*a* and sends the received electromagnetic waves to the signal processor, or sends electromagnetic waves, which the signal processor tries to output, to the first radiation plate 13*a*. Such a signal processor is, for example, a chip having a radio frequency module, a radio frequency chip or another suitable chip, and this embodiment is not limited thereto.

The feeding part 15*a* has a feeding point at an end of the first conductor section 151*a*, which is not connected to the second conductor section 152*a*, and the feeding part 15*a* has a signal point at an end of the third conductor section 153*a*, which is connected to the signal processor. A direction extending from the feeding point to the signal point represents a feeding direction. In this embodiment, the feeding direction of the upper feeding part 15*a* is substantially vertically to the feeding directions of the left and right feeding parts 15*a*, so the upper feeding part 15*a* and the right feeding part 15*a* respectively correspond to the horizontal polarization work mode and vertical polarization work mode of the polarized antenna 10*a*, and the upper feeding part 15*a* and the left feeding part 15*a* respectively correspond to the horizontal polarization work mode and vertical polarization work mode of the polarized antenna 10*a*. Similarly, the feeding direction of the lower feeding part 15*a* is substantially vertical to the feeding directions of the left and right feeding parts 15*a*, so the lower feeding part 15*a* and the right feeding part 15*a* respectively correspond to the horizontal polarization work mode and vertical polarization work mode of the polarized antenna 10*a*, and the lower feeding part 15*a* and the left feeding part 15*a* respectively correspond to the horizontal polarization work mode and vertical polarization work mode of the polarized antenna 10*a*.

As the polarized antenna 10*a* tries to receive and transmit electromagnetic waves, the coupling gap D2 between the first conductor section 151*a* of the feeding part 15*a* and the first radiation plate 13*a* could guide the near field energy of the feeding part 15*a* to the first radiation plate 13*a*, so the first conductor section 151*a*, the second conductor section 152*a*, the third conductor section 153*a* of the feeding part 15*a* and the first radiation plate 13*a* constitute a resonance path. The resonance configuration of the resonance paths forms the resonant frequency band of the polarized antenna 10*a*, so the signal processor employs the feeding parts 15*a* and the first radiation plate 13*a* to receive and transmit electromagnetic wave signals of a communication device in the resonant frequency band. The frequencies of the resonant frequency band are related to the length of the resonance path; for example, the length of the resonance path is one half times the wavelength corresponding to the resonant frequency band of the polarized antenna 10*a*, but this embodiment is not limited thereto.

In an embodiment, in the polarized antenna 10*a*, the length of the resonance path is adjustable according to the lengths of the first conductor section 151*a*, the second conductor section 152*a* and the third conductor section 153*a* of the feeding part 15*a* and the diameter of the first radiation plate 13*a*. Moreover, the resonance paths each constituted by one of the four feeding parts 15*a* and the first radiation plate 13*a* would form the same resonant frequency band, or two of the resonance paths of the four feeding parts 15*a* would cause the same resonant frequency band, or the resonance path of each of the four feeding parts 15*a* would cause a different resonant frequency band, and this embodiment is not limited thereto. In an embodiment, when each of the four feeding parts 15*a* causes a different resonant frequency band, two adjacent resonant frequency bands at least cover the same band of frequencies for a communication system.

The four grounded parts 17*a* are located between the four feeding parts 15*a* and electrically connected to the conductive layer 112*a* and the signal ground end. The grounded parts 17*a* play a role to insulate the four feeding parts 15*a* from each other to efficiently shorten the resonance paths respectively constituted by the four feeding parts 15*a* and the first radiation plate 13*a* and reduce the interference from the resonant modes of the resonance paths, so as to enhance the insulation that the four feeding parts 15*a* are feeding signals.

Figure 2:
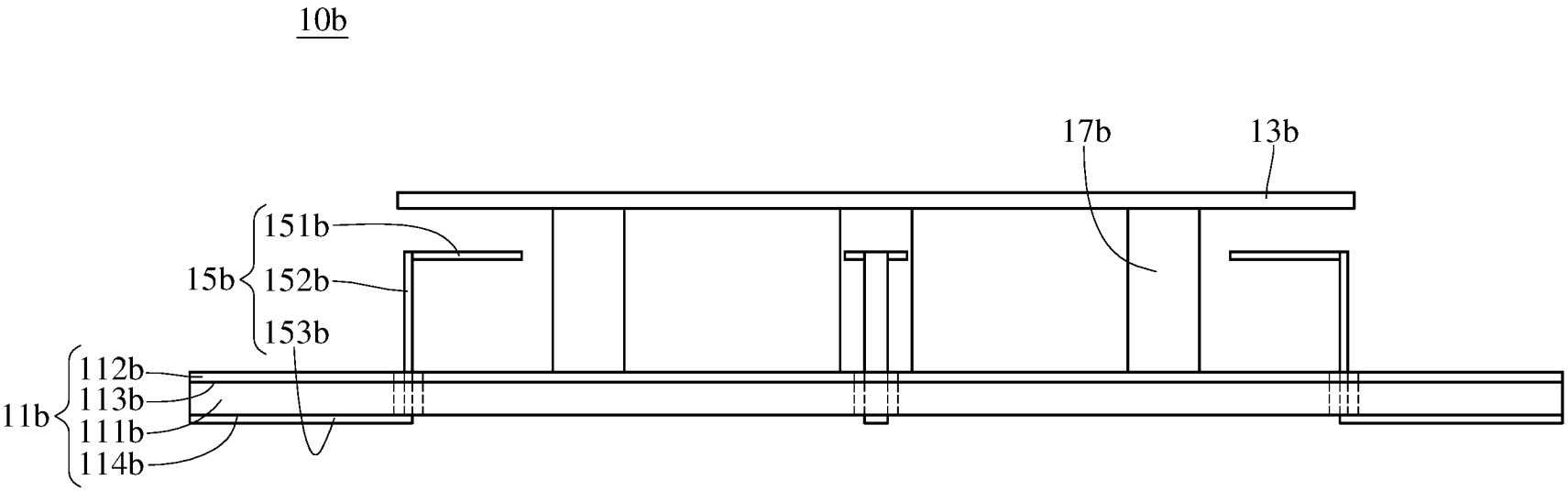
FIG. 2 is a side view of the second embodiment of a polarized antenna in the disclosure.

Next, other embodiments of the polarized antenna are described as follows. Please refer to FIG. 2. FIG. 2 is a side view of the second embodiment of a polarized antenna in the disclosure. As shown in FIG. 2, a polarized antenna 10*b* includes a load board 11*b*, a first radiation plate 13*b*, four feeding parts 15*b* and four grounded parts 17*b*. The load board 11*b* includes a dielectric layer 111*b* and a conductive layer 112*b*. The dielectric layer 111*b* has a first surface 113*b* and a second surface 114*b* opposite to the first surface 113*b*, i.e. the upper and lower parallel surfaces of the dielectric layer 111*a*. The conductive layer 112*b* is located on the first surface 113*b* of the dielectric layer 111*b*. The first radiation plate 13*b* is disposed above the load board 11*b* through the support of the grounded parts 17*b* or other pillars of insulation material and is close to the first surface 113*b* of the dielectric layer 111*b*, so the first radiation plate 13*b* and the conductive layer 112*b* have a first resonance gap therebetween. In an embodiment, the first radiation plate 13*b* and the load board 11*b* are flat plate structures, and the normal vector of the first radiation plate 13*b* is substantially parallel to the normal vector of the load board 11*b*.

The four feeding parts 15*b* are located on the load board 11*b*, and each of the feeding parts 15*b* includes a first conductor section 151*b*, a second conductor section 152*b* and a third conductor section 153*b*. The second conductor section 152*b* is located between the first conductor section 151*b* and the third conductor section 153*b*. The first conductor section 151*b* is located above the load board 11*b* and is close to the first surface 113*b* of the dielectric layer 111*b*. The second conductor section 152*b* passes through the load board 11*b*. The third conductor section 153*b* touches and is connected to the second surface 114*b* of the dielectric layer 111*b*. The third conductor section 153*b* is insulated from the conductive layer 112*b*. Similar to the previous embodiment, the first conductor section 151*b* and the second conductor section 152*b* are covered by and located under the first radiation plate 13*b*, and a part of the third conductor section 153*b* is also covered by and located under the first radiation plate 13*b*; but this embodiment is not limited thereto. In the side view, the first conductor section 151*b* and the first radiation plate 13*b* have a coupling gap therebetween.

The four grounded parts 17*b* are located on the load board 11*b* and connected to the conductive layer 112*b*. In this embodiment, the grounded parts 17*b* are connected to the first radiation plate 13*b*; and however, in another embodiment, one or more of the grounded parts 17*b* may not be connected to the first radiation plate 13*b*, and the top of the grounded part 17*b* and the first radiation plate 13*b* have a gap therebetween. The four grounded parts 17*b* are located between the four feeding parts 15*b* and electrically connected to the conductive layer 112*b*, so the four grounded parts play a role to insulate the four feeding parts 15*b* from each other, so as to shorten the resonance paths respectively constituted by the four feeding parts 15*b* and the first radiation plate 13*b* and reduce the interference between the resonance paths. Therefore, the insulation that the four feeding parts 15*b* are feeding signal may be enhanced.

Figure 3:
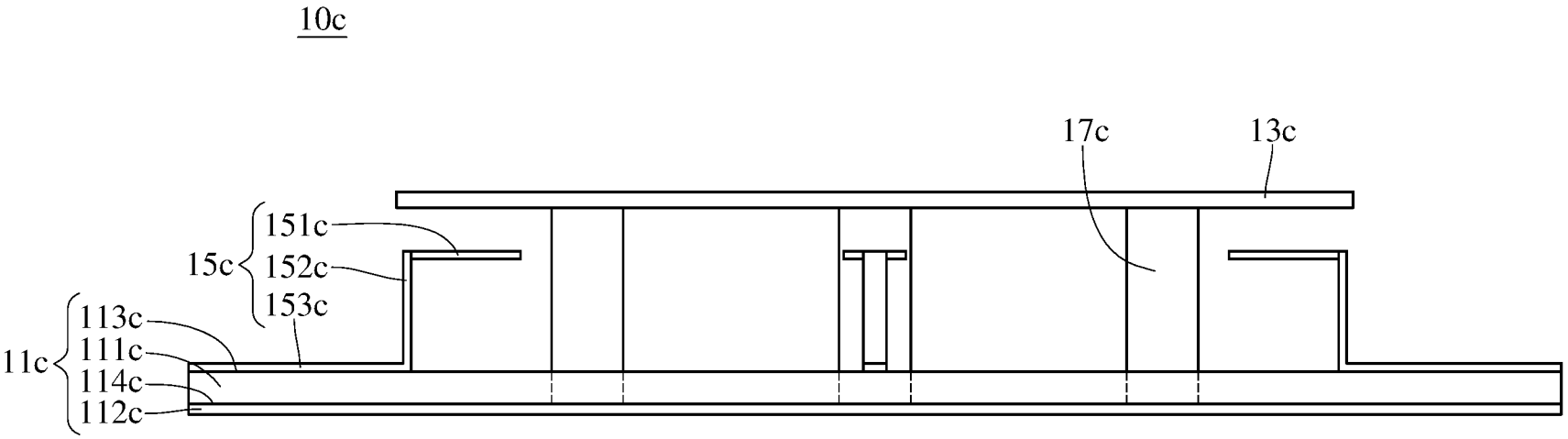
FIG. 3 is a side view of the third embodiment of a polarized antenna in the disclosure.

Please refer to FIG. 3. FIG. 3 is a side view of the third embodiment of a polarized antenna in the disclosure. As shown in FIG. 3, a polarized antenna 10*c* includes a load board 11*c*, a first radiation plate 13*c*, four feeding parts 15*c* and four grounded parts 17*c*. The load board 11*c*, the first radiation plate 13*c*, the four feeding parts 15*c* and the four grounded parts 17*c* are substantially the same as the relevant components in the first embodiment, respectively. Differences between the first and third embodiments include: a conductive layer 112*c* is located on a second surface 114*c* of a dielectric layer 111*c*, and the four feeding parts 15*c* are located on a first surface 113*c* of the dielectric layer 111*c*, and since the conductive layer 112*c* and each feeding part 15*c* are respectively disposed on two opposite surfaces of the load board 11*c*, the conductive layer 112*c* is insulated from each feeding part 15*c*. In this embodiment, the four grounded parts 17*c* are located on the first surface 113*c* of the dielectric layer 111*c* and pass through the load board 11*c*, so as to be electrically connected to the conductive layer 112*c*.

Figure 4:
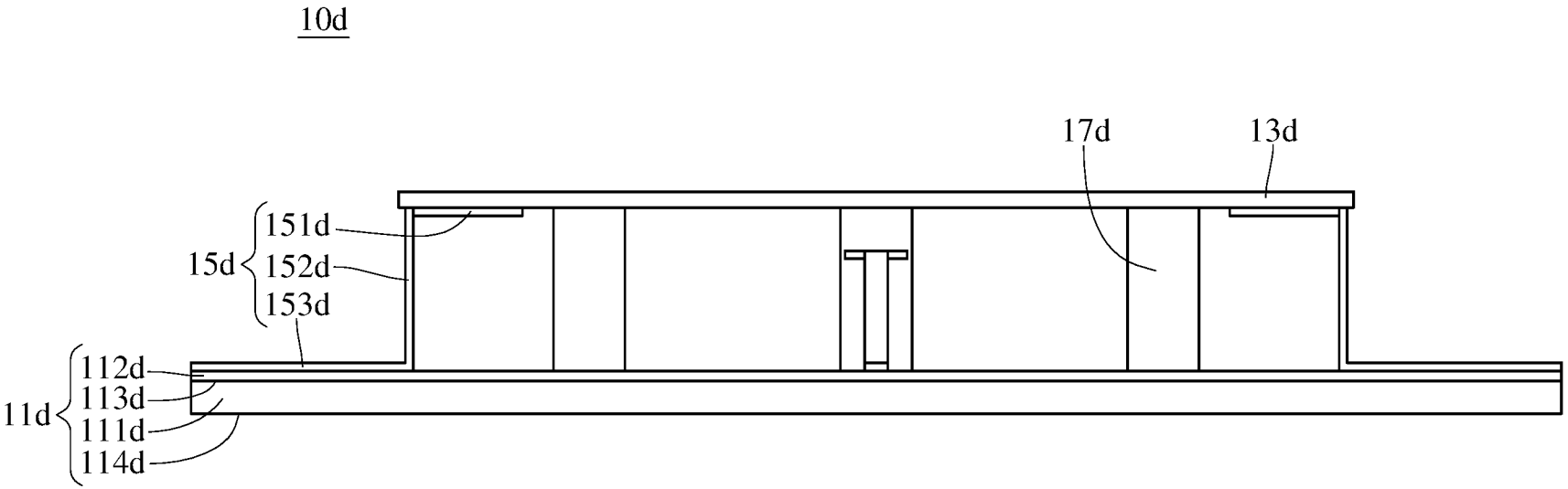
FIG. 4 is a side view of the fourth embodiment of a polarized antenna in the disclosure.

Please refer to FIG. 4. FIG. 4 is a side view of the fourth embodiment of a polarized antenna in the disclosure. As shown in FIG. 4, a polarized antenna 10*d* includes a load board 11*d*, a first radiation plate 13*d*, four feeding parts 15*d* and four grounded parts 17*d*. The load board 11*d*, the first radiation plate 13*d*, the four feeding parts 15*d* and the four grounded parts 17*d* are substantially the same as the relevant components in the first embodiment, respectively. Differences between the first and fourth embodiments include: a first conductor section 151*d* of the feeding part 15*d* touches the first radiation plate 13*d*.

Likewise, the first conductor section may touch the first radiation plate in the second and third embodiments, so as to produce two other embodiments, which are not repeated hereinafter. The connection between the first conductor section 151*d* and the first radiation plate 13*d* is carried out by, for example, a metal fastener, welding or other suitable manners. The feeding part 15*d* can touch the first radiation plate 13*d* via the first conductor section 151*d* to constitute a resonance path with the first radiation plate 13*d* by a directly feeding manner, and the resonance paths form a resonant frequency band of the polarized antenna 10*d*. Therefore, the signal processor can receive or transmit electromagnetic wave signals of a communication device in the resonant frequency band via the feeding parts 15*d* and the first radiation plate 13*d*.

Figure 5:
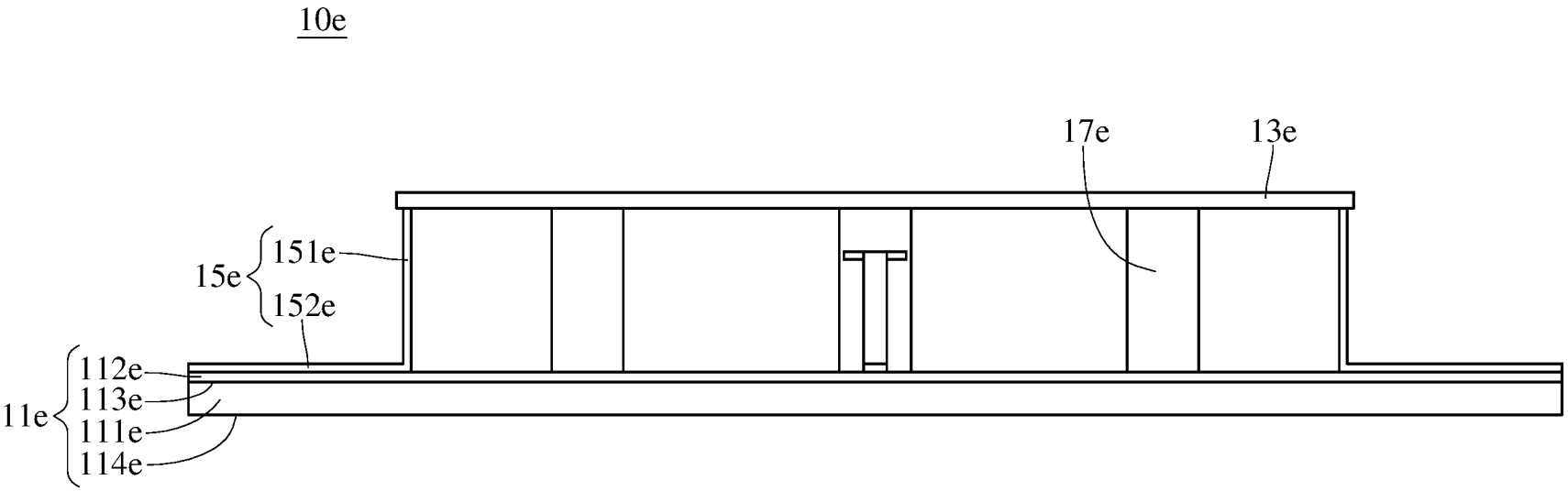
FIG. 5 is a side view of the fifth embodiment of a polarized antenna in the disclosure.

However, the first conductor section 151*d* may be removed from the design of the fourth embodiment. Please refer to FIG. 5. FIG. 5 is a side view of the fifth embodiment of a polarized antenna in the disclosure. As shown in FIG. 5, a polarized antenna 10*e* includes a load board 11*e*, a first radiation plate 13*e*, four feeding parts 15*e* and four grounded parts 17*e*. The load board 11*e* includes a dielectric layer 111*e* and a conductive layer 112*e*. The dielectric layer 111*e* has a first surface 113*e* and a second surface 114*e* opposite to the first surface 113*e*, and the conductive layer 112*e* is located on the first surface 113*e* of the dielectric layer 111*e*.

The four feeding parts 15*e* are located under the first radiation plate 13*e* and located on the conductive layer 112*e* of the load board 11*e* and are insulated from the conductive layer 112*e*. In this embodiment, each of feeding parts 15*e* includes a first end 151*e* and a second end 152*e*. The second end 152*e* touches and is connected to the conductive layer 112*e* of the load board 11*e*, and the second end 152*e* is insulated from the conductive layer 112*e*. The first end 151*e* is substantially vertically disposed on the load board 11*e* or is obliquely disposed on the load board 11*e*, and the first end 151*e* touches the first radiation plate 13*e*.

In the figure, the first end 151*e* and a part of the second end 152*e* are covered by and located under the first radiation plate 13*e*. In another embodiment, a second conductor section is obliquely disposed on the load board 11*e*, a part of the first end 151*e* is covered by and located under the first radiation plate 13*e*, and the second end 152*e* is not covered by the first radiation plate 13*e*; this embodiment is not limited thereto.

The second end 152*e* of the feeding part 15*e* is insulated from the conductive layer 112*e*. In addition to the manner shown in FIG. 5, any person having ordinary skill in the art can modify the second end 152*e* and the conductive layer 112*e* in FIG. 5 in view of the embodiments shown in FIG. 2 and FIG. 3, and it will not be repeated herein.

Figure 6:
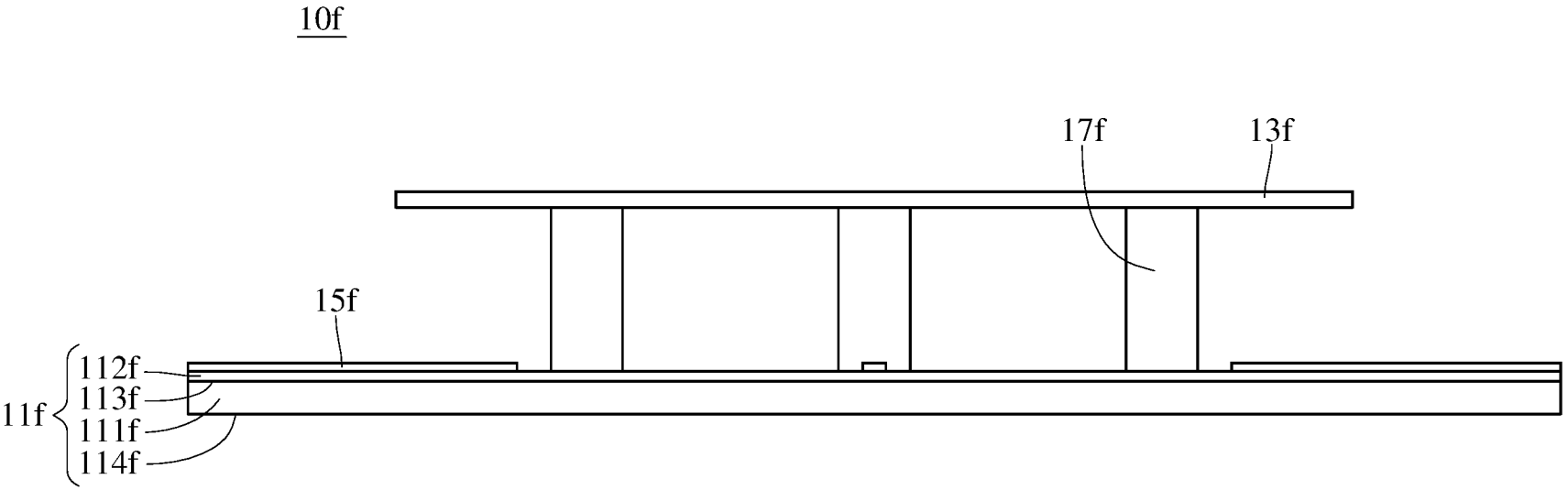
FIG. 6 is a side view of the sixth embodiment of a polarized antenna in the disclosure.

Then, other types of the feeding part are contemplated. Please refer to FIG. 6. FIG. 6 is a side view of the sixth embodiment of a polarized antenna in the disclosure. As shown in FIG. 6, a polarized antenna 10*f* includes a load board 11*f*, a first radiation plate 13*f*, four feeding parts 15*f* and four grounded parts 17*f*. The load board 11*f* includes a dielectric layer 111*f* and a conductive layer 112*f*, and the dielectric layer 111*f* has a first surface 113*f* and a second surface 114*f* opposite to the first surface 113*f*. The conductive layer 112*f* is located on the first surface 113*f* of the dielectric layer 111*f*. The first radiation plate 13*f* is located above the load board 11*f* and is close to the first surface 113*f* of the dielectric layer 111*f*. The first radiation plate 13*f* and the conductive layer 112*f* have a first resonance gap therebetween because of the support of the grounded parts 17*f* or other pillars of insulation material. In this embodiment, the first radiation plate 13*f* and the load board 11*f* are flat plate structures, and the normal vector of the first radiation plate 13*f* is substantially parallel to the normal vector of the load board 11*f*.

The four feeding parts 15*f* are located under the first radiation plate 13*f* and located on the conductive layer 112*f* of the load board 11*f*, and the four feeding parts 15*f* are insulated from the conductive layer 112*f*. In this embodiment, a part of the feeding part 15*f* is covered by and located under the first radiation plate 13*f*, and the part of the feeding part 15*f* covered by the first radiation plate 13*f* has a coupling gap with the first radiation plate 13*f*. When the polarized antenna 10*f* would like to electromagnetic waves, the coupling gap between the feeding part 15*f* and the first radiation plate 13*f* can guide the energy on the feeding part 15*f* to the first radiation plate 13*f*, so the feeding part 15*f* and the first radiation plate 13*f* together form a resonance path. The resonance configuration of the resonance paths forms a resonant frequency band of the polarized antenna 10*f*, so the signal processor can receive and transmit electromagnetic wave signals of a communication device in the resonant frequency band via the feeding parts 15*f* and the first radiation plate 13*f*. The resonant frequency band of the polarized antenna 10*f* is related to the coupling gap between the feeding parts 15*f* and the first radiation plate 13*f*.

The four grounded parts 17*f* are located between the four feeding parts 15*f* and electrically connected to the conductive layer 112*f*, so as to be electrically connected to a signal ground end. The grounded parts 17*f* play a role to insulate the four feeding parts 15*f* from each other, so as to efficiently shorten the resonance paths respectively constituted by the four feeding parts 15*f* and the first radiation plate 13*f* and reduce the interference from the resonant modes of the resonance paths. Therefore, the insulation that the four feeding parts 15*f* are feeding signals may be enhanced. In this embodiment, the four grounded parts 17*f* are connected to the first radiation plate 13*f*; in another embodiment, the grounded parts 17*f* are separated from the first radiation plate 13*f*, so the grounded parts 17*f* have a gap with the first radiation plate 13*f*. In yet another embodiment, a part of the four grounded parts 17*f* is connected to the first radiation plate 13*f*, and the other part of the four grounded parts 17*f* has a gap with the first radiation plate 13*f*, and this embodiment is not limited thereto.

Figure 7:
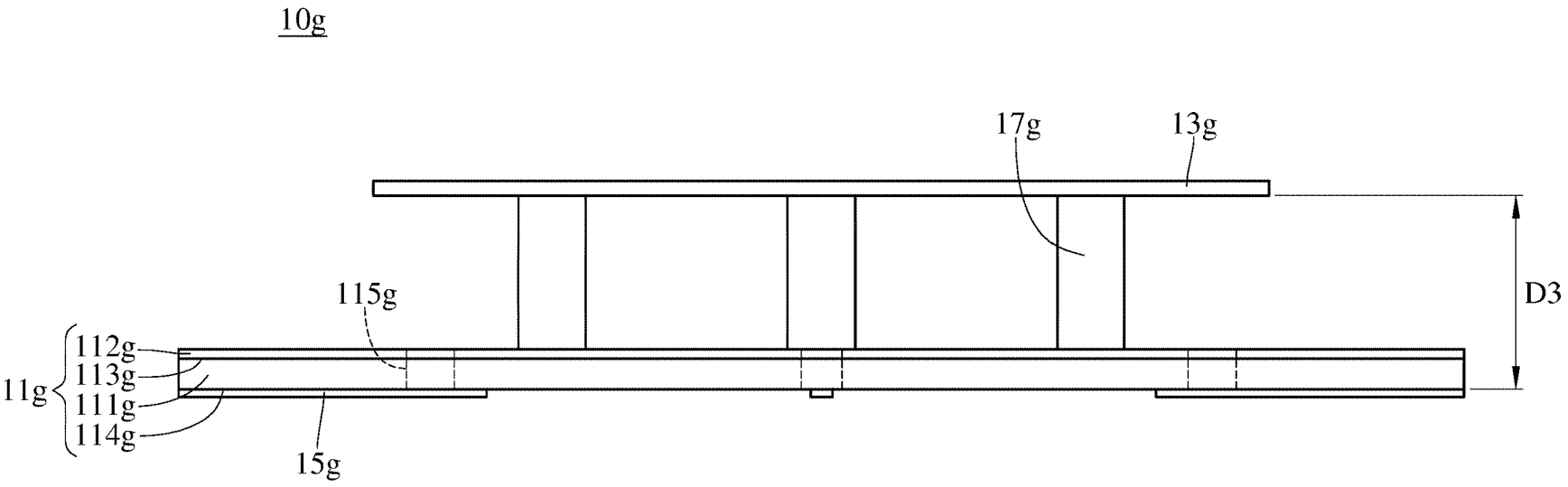
FIG. 7 is a side view of the seventh embodiment of a polarized antenna in the disclosure.

Please refer to FIG. 7. FIG. 7 is a side view of the seventh embodiment of a polarized antenna in the disclosure. As shown in FIG. 7, a polarized antenna 10*g* includes a load board 11*g*, a first radiation plate 13*g*, four feeding parts 15*g* and four grounded parts 17*g*. The load board 11*g* includes a dielectric layer 111*g*, a conductive layer 112*g* and four through holes 115*g*. The dielectric layer 111*g* has a first surface 113*g* and a second surface 114*g* opposite to the first surface 113*g*. The conductive layer 112*g* is located on the first surface 113*g* of the dielectric layer 111*g*. The first radiation plate 13*g* is located above the load board 11*g* and is close to the first surface 113*g* of the dielectric layer 111*g*. The first radiation plate 13*g* and the conductive layer 112*g* have a first resonance gap therebetween via the support of the grounded parts 17*g* or other pillars of insulation material. In this embodiment, the first radiation plate 13*g* and the load board 11*g* are flat plate structures, and the normal vector of the first radiation plate 13*g* is substantially parallel to the normal vector of the load board 11*g*. The four through holes 115*g* pass through the dielectric layer 111*g* and the conductive layer 112*g* and are covered by and located under the first radiation plate 13*g*.

The four feeding parts 15*g* are located under the first radiation plate 13*g* and located on the second surface 114*g* of the dielectric layer 111*g*. At least a part of each of the feeding parts 15*g* overlaps the related through hole 115*g*. In this embodiment, the overlap between the feeding part 15*g* and the through hole 115*g* is also covered by and located under the first radiation plate 13*g*. Via the through holes 115*g*, the feeding parts 15*g* have a coupling gap D3 with the first radiation plate 13*g*. When the polarized antenna 10*g* would like to receive or transmit electromagnetic waves, the coupling gap between the feeding parts 15*g* and the first radiation plate 13*g* can guide the energy on the feeding parts 15*g* to the first radiation plate 13*g*, so the feeding part 15*g* and the first radiation plate 13*g* constitute a resonance path, thereby forming a resonant frequency band of the polarized antenna 10*g*. Therefore, the signal processor receives and transmits electromagnetic wave signals of a communication device in the resonant frequency band via the feeding parts 15*g* and the first radiation plate 13*g*.

The four grounded parts 17*g* are located between the four feeding parts 15*g* and electrically connected to the conductive layer 112*g*, so as to be electrically connected to a signal ground end and play a role to insulate the four feeding parts 15*g* from each other. Similar to the previous embodiment, whether the four grounded parts 17*g* are connected to the first radiation plate 13*g* or not can be designed according to a variety of actual requirements, and this embodiment has no limitation thereon.

In the previous embodiments, the amount of feeding parts and the amount of grounded parts are 4 as examples. In practice, the amount of feeding parts is M, the amount of grounded parts is N, M is a positive integer larger than 2, and N is a positive integer larger than 1. Moreover, this embodiment has no limitation on the amounts and positions of feeding parts and grounded parts. Other embodiments based on a variety of amounts and a variety of positions of the grounded part are illustrated below.

Figure 8:
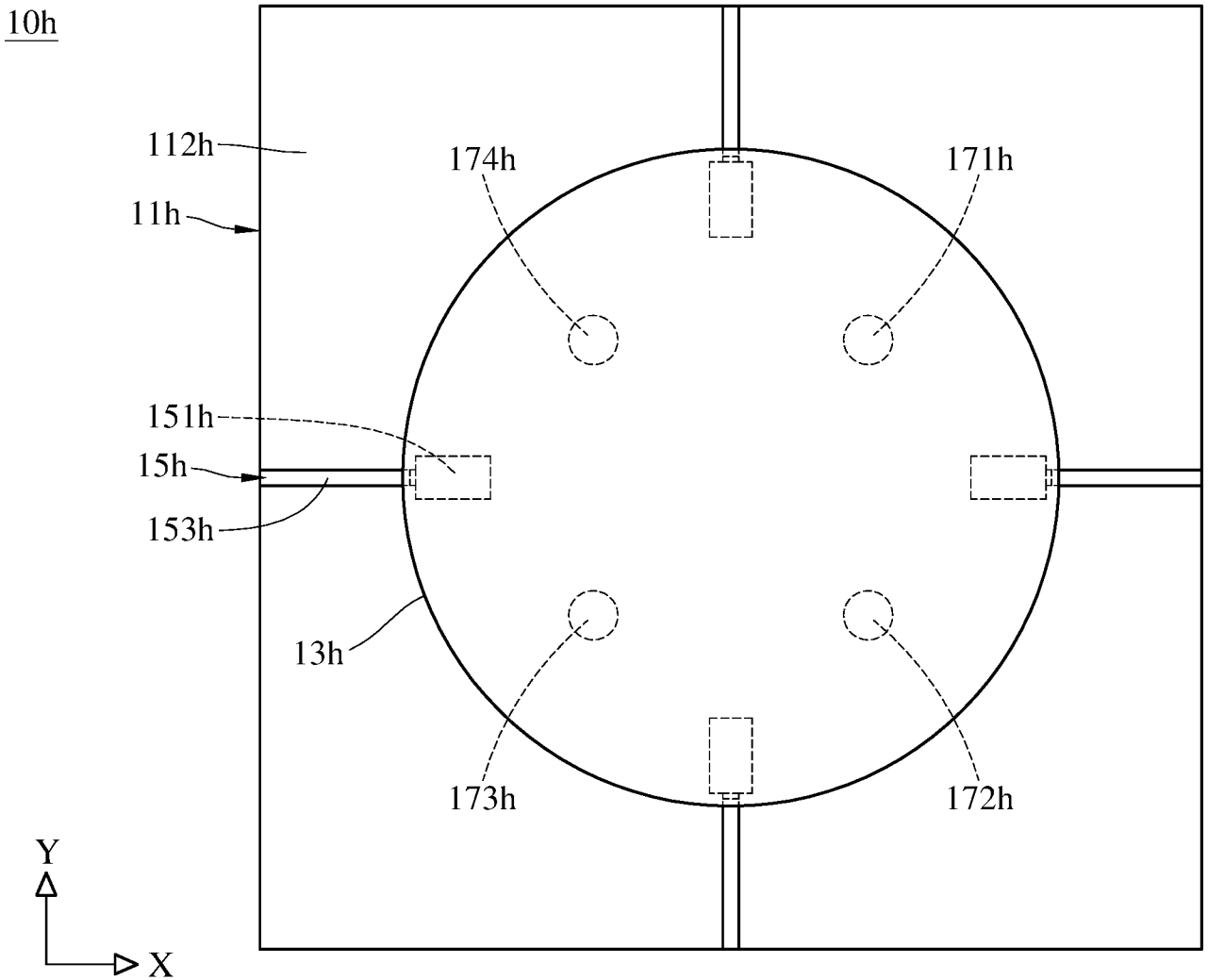
FIG. 8 is a top view of the eighth embodiment of a polarized antenna in the disclosure.

Please refer to FIG. 8. FIG. 8 is a top view of the eighth embodiment of a polarized antenna in the disclosure. As shown in FIG. 8, a polarized antenna 10*h* includes a load board 11*h*, a first radiation plate 13*h*, four feeding parts 15*h* and four grounded parts 17*h*. The load board 11*h*, the first radiation plate 13*h* and the four feeding parts 15*h* could be carried out by the previous embodiments. In this embodiment, based on the orientation of the figure, the four feeding parts 15*h* are sorted to the upper, lower, left and right feeding parts 15*h*, and the orientations of "upper", "lower", "left" and "right" are only for clear description rather than limiting the positions of the feeding parts 15*h*. The left and right feeding parts 15*h* extend in a positive direction and a reverse direction along the first preset axis X, and the upper and lower feeding parts 15*h* extend in a positive direction and a reverse direction along the second preset axis Y.

The four grounded parts 17*h* are sorted to a first grounded part 171*h*, a second grounded part 172*h*, a third grounded part 173*h* and a fourth grounded part 174*h*. The first grounded part 171*h*, the second grounded part 172*h*, the third grounded part 173*h* and the fourth grounded part 174*h* are covered by and located under the first radiation plate 13*h*. The first grounded part 171*h* is located in between the positive direction on the first preset axis X and the positive direction on the second preset axis Y, the second grounded part 172*h* is located in between the positive direction on the first preset axis X and the reverse direction on the second preset axis Y, the third grounded part 173*h* is located in between the reverse direction on the first preset axis X and the reverse direction on the second preset axis Y, and the fourth grounded part 174*h* is located in between the reverse direction on the first preset axis X and the positive direction on the second preset axis Y.

In an embodiment, if a path from the center point of the first radiation plate 13*h* as a base point to the upper feeding part 15*h* represents a 0° angle, the first grounded part 171*h* is located on a path represented by a clockwise angle of 45°, the second grounded part 172*h* is located on a path represented by a clockwise angle of 135°, the fourth grounded part 174*h* is located on a path represented by an anticlockwise angle of 45°, the third grounded part 173*h* is located on a path represented by an anticlockwise angle of 135°, and the first grounded part 171*h*, the second grounded part 172*h*, the third grounded part 173*h* and the fourth grounded part 174*h* have the same distance with the base point. The foregoing angles of 45° and 135° are only for clear explanation and concise drawing rather than limiting the embodiment; and other embodiments may be contemplated in which the foregoing angles of 45° and 135° are replaced by other angles, and have no limitation on them.

Figure 9:
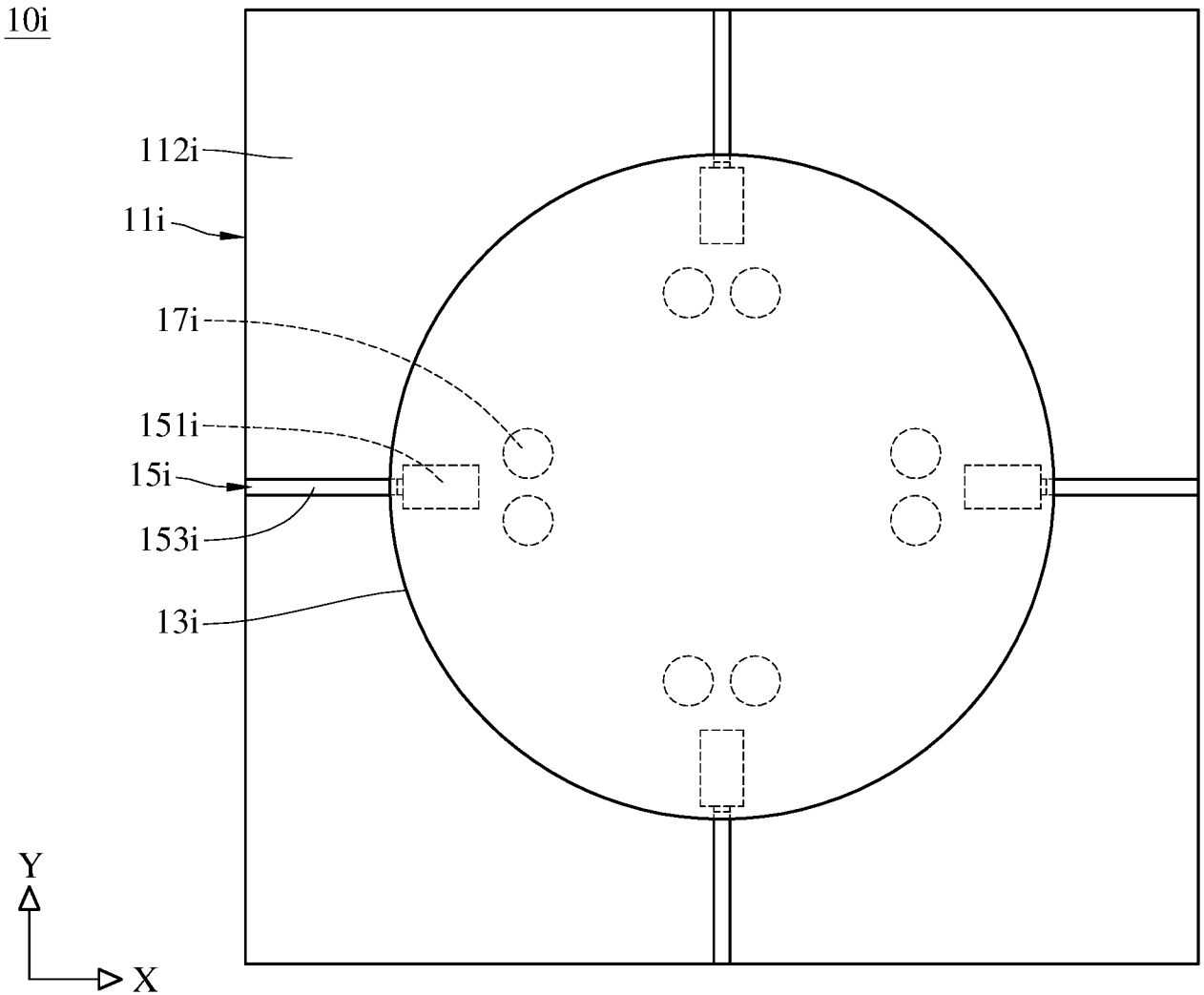
FIG. 9 is a top view of the ninth embodiment of a polarized antenna in the disclosure.
Figure 10:
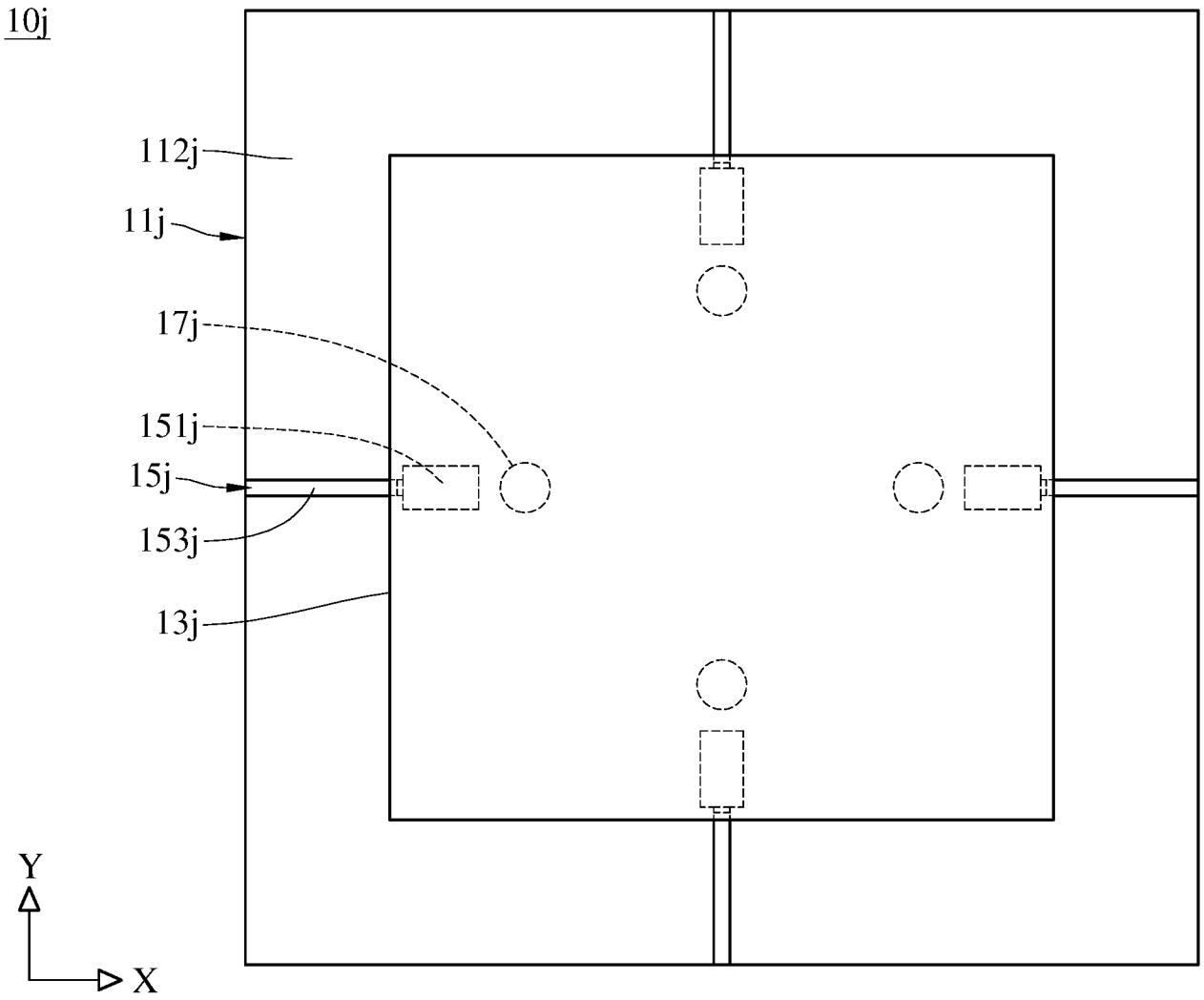
FIG. 10 is a top view of the tenth embodiment of a polarized antenna in the disclosure.
Figure 11:
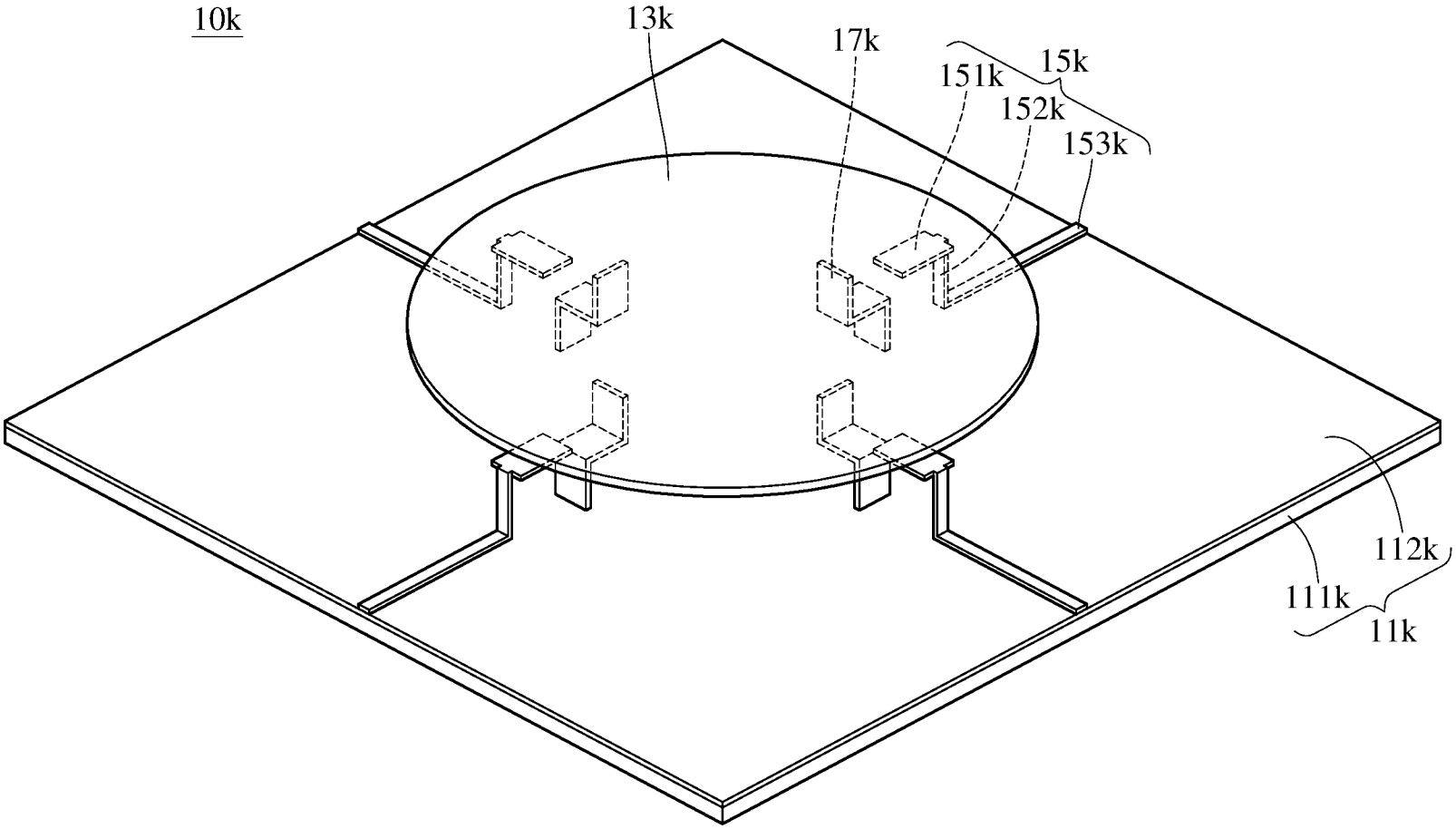
FIG. 11 is a perspective view of the eleventh embodiment of a polarized antenna in the disclosure.

In other embodiments, the amount and shape of the grounded part, the shape of the load board and the shape of the first radiation plate can be designed according to a variety of actual requirements. Please refer to FIG. 9 to FIG. 11. FIG. 9 is a top view of the ninth embodiment of a polarized antenna in the disclosure, FIG. 10 is a top view of the tenth embodiment of a polarized antenna in the disclosure, and FIG. 11 is a perspective view of the eleventh embodiment of a polarized antenna in the disclosure. For example, the amount of the grounded part 17*i* is designed as shown in FIG. 9, the shape of the first radiation plate 13*k* is designed as shown in FIG. 10, and the shape of the grounded part 17*k* is designed as shown in FIG. 11.

Figure 12:
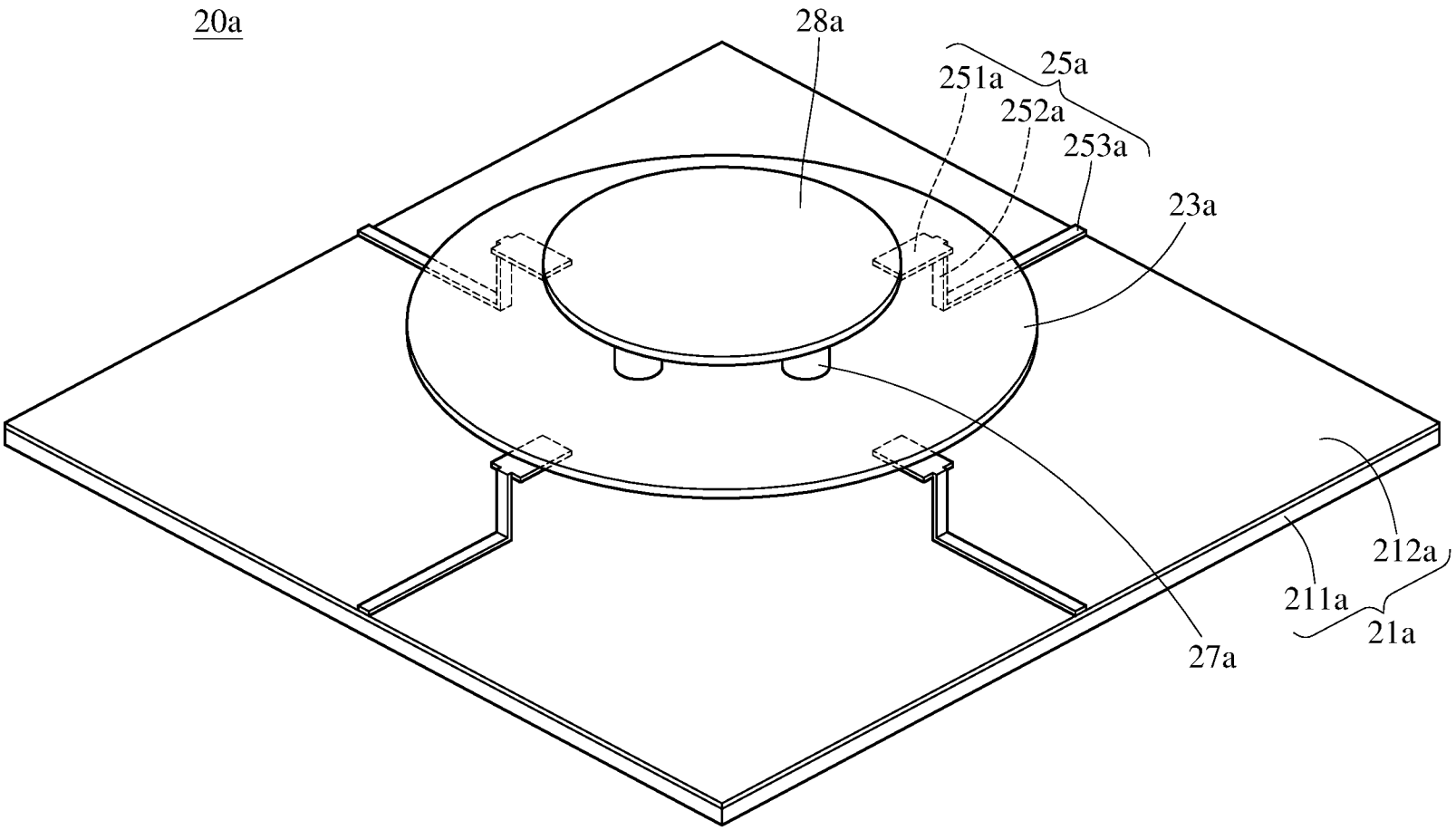
FIG. 12 is a perspective view of the twelfth embodiment of a polarized antenna in the disclosure.
Figure 13:
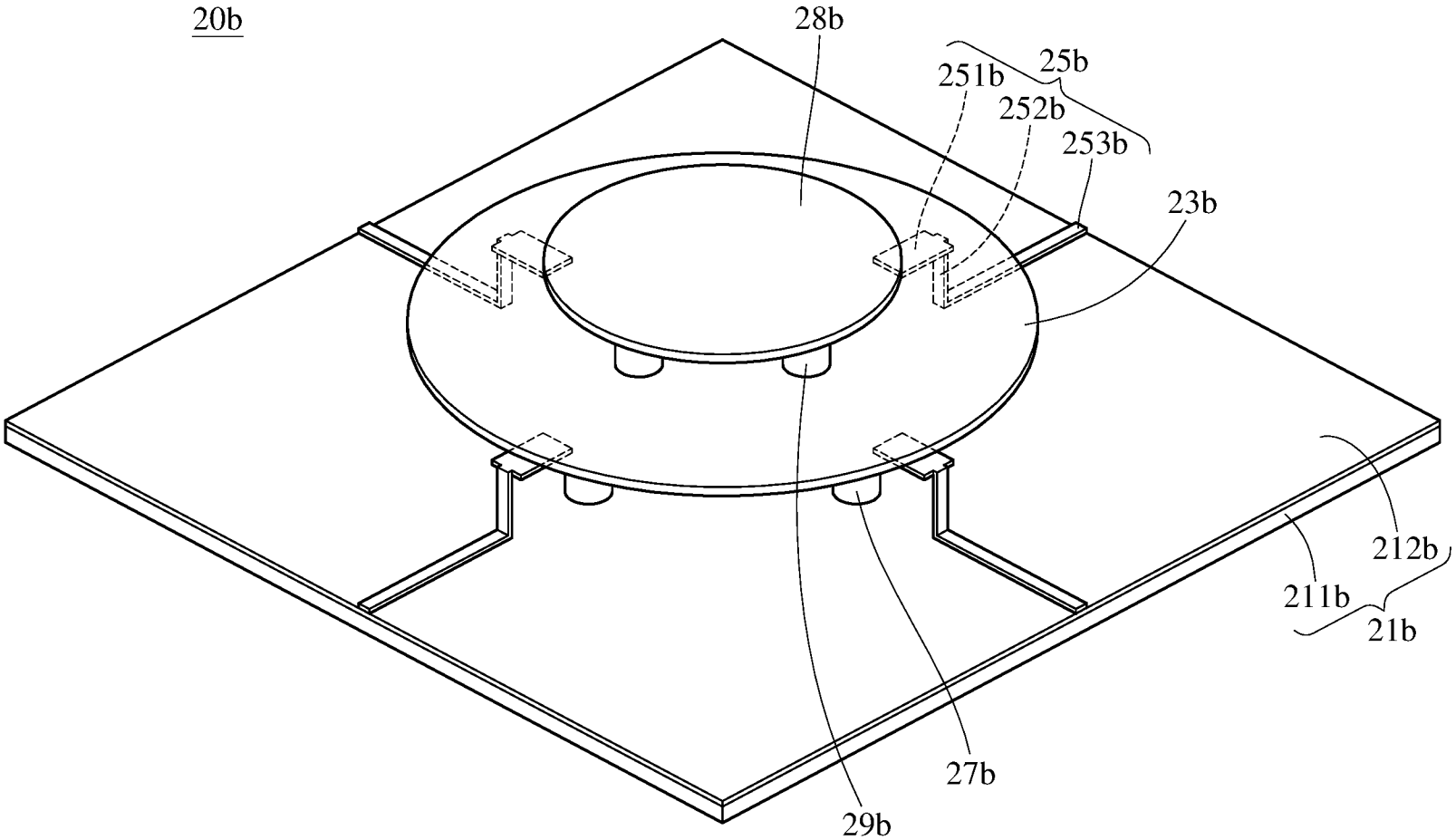
FIG. 13 is a perspective view of the thirteenth embodiment of a polarized antenna in the disclosure.

Please refer to FIG. 12 and FIG. 13. FIG. 12 is a perspective view of the twelfth embodiment of a polarized antenna in the disclosure, and FIG. 13 is a perspective view of the thirteenth embodiment of a polarized antenna in the disclosure. In view of the figures, a polarized antenna 20*a* includes a load board 21*a*, a first radiation plate 23*a*, M pieces of feeding part 25*a*, N pieces of grounded part 27*a* and a second radiation plate 28*a*. The load board 21*a*, the first radiation plate 23*a*, the M pieces of feeding part 25*a* and the N pieces of grounded part 27*a* could be carried out by the previous embodiments. In this embodiment, the second radiation plate 28*a* is located above the first radiation plate 23*a* and has a second resonance gap with the first radiation plate 23*a*.

The second radiation plate 28*a* is disposed above the first radiation plate 23*a* via the support of one or more grounded parts 27*a*, and the grounded part 27*a* passes through the first radiation plate 23*a* and is connected to the second radiation plate 28*a*, as shown in FIG. 12. In another embodiment, as shown in FIG. 13, a polarized antenna 20*b* further includes P pieces of connecting part 29*b*, and a second radiation plate 28*b* is disposed above a first radiation plate 23*b* via the support of the P pieces of connecting part 29*b*, where P is a positive integer. The material of the connecting part 29*b* is, for example, metal conductor or an insulation material, and the embodiment is not limited thereto. In an embodiment, the width of a second resonance gap between the second radiation plate 28*b* and the first radiation plate 23*b* is smaller than or substantially equal to the width of a first resonance gap between the first radiation plate 23*b* and a load board 21*b*.

When the polarized antenna would like to receive or transmit electromagnetic waves, the second resonance gap between the second radiation plate 28*b* and the first radiation plate 23*b* could couple the near field energy on the first radiation plate 23*b* to the second radiation plate 28*b*, so the feeding part 25*b*, the first radiation plate 23*b* and the second radiation plate 28*b* institute a resonance path, so as to form a resonant frequency band of the polarized antenna 20*b*. In an embodiment, the diameter of the first radiation plate 23*b* and the diameter of the second radiation plate 28*b* are related to the distance between the first radiation plate 23*b* and the second radiation plate 28*b*. In another embodiment, the diameter of the first radiation plate 23*b* and the diameter of the second radiation plate 28*b* are related to the N pieces of grounded part 27*b*. In yet another embodiment, the diameter of the first radiation plate 23*b* and the diameter of the second radiation plate 28*b* are 0.3~0.7 times the wavelength corresponding to the resonant frequency band, but this embodiment is not limited thereto.

Figure 14:
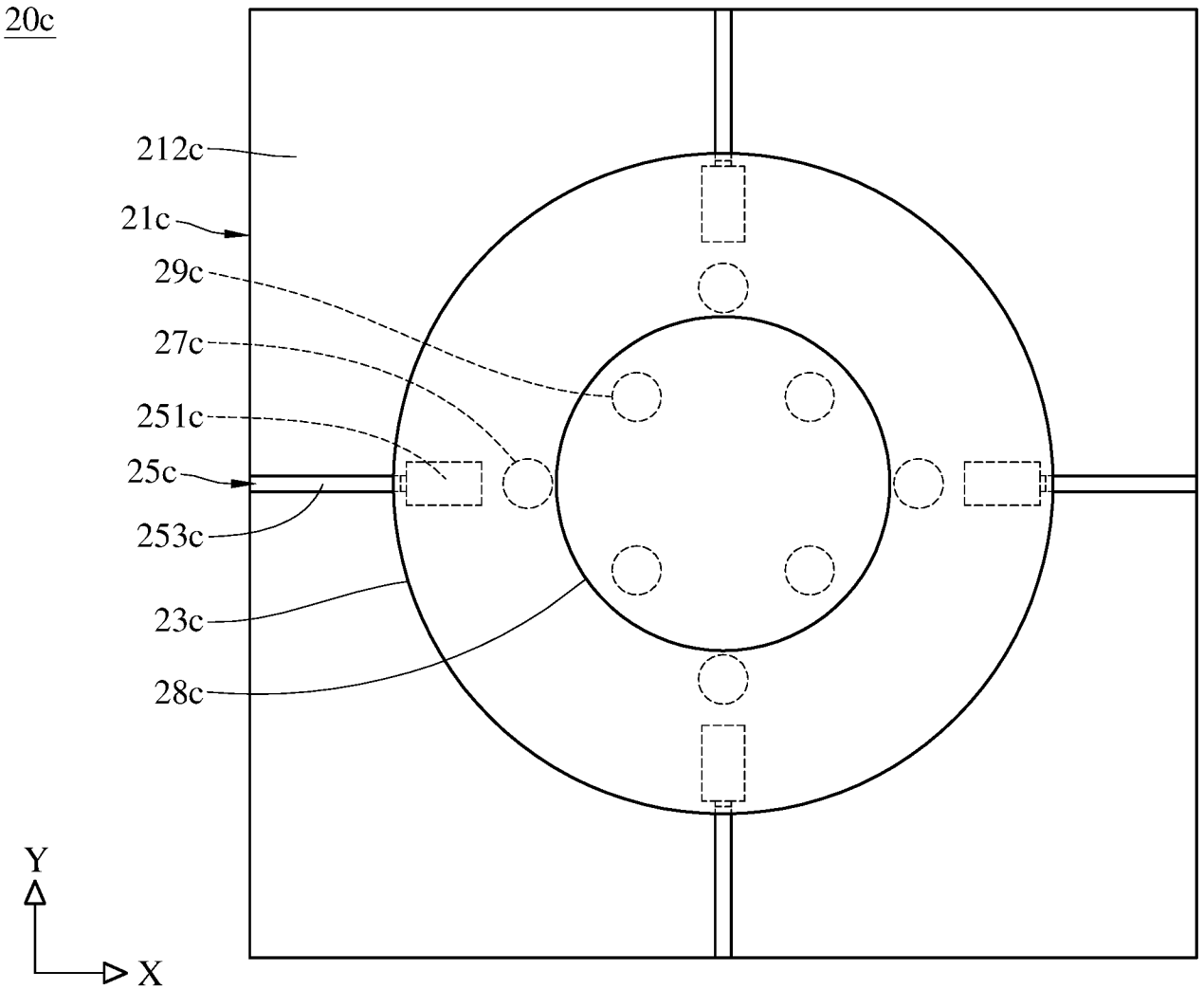
FIG. 14 is a top view of the fourteenth embodiment of a polarized antenna in the disclosure.
Figure 15:
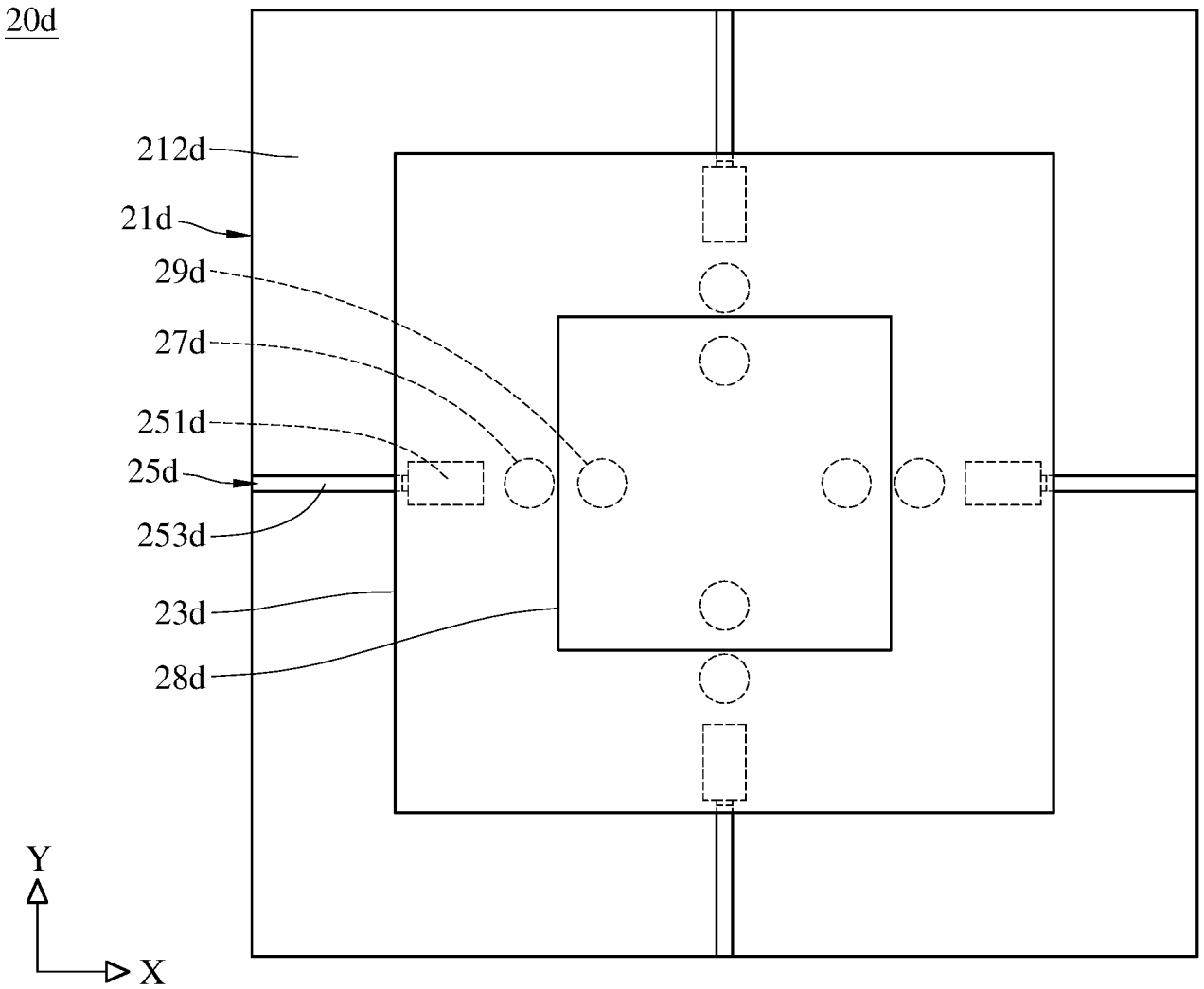
FIG. 15 is a top view of the fifteenth embodiment of a polarized antenna in the disclosure.
Figure 16:
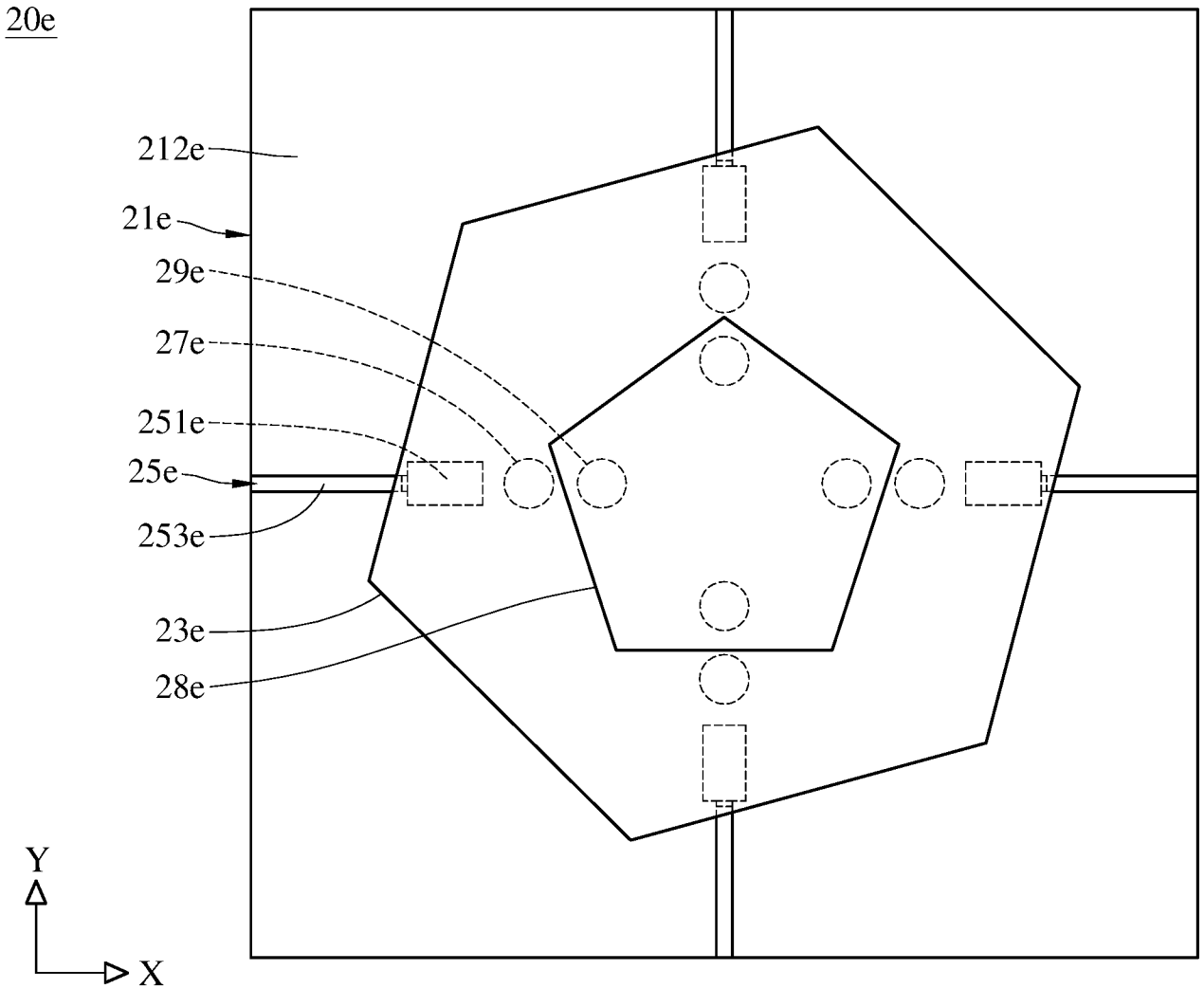
FIG. 16 is a top view of the sixteenth embodiment of a polarized antenna in the disclosure.
Figure 17:
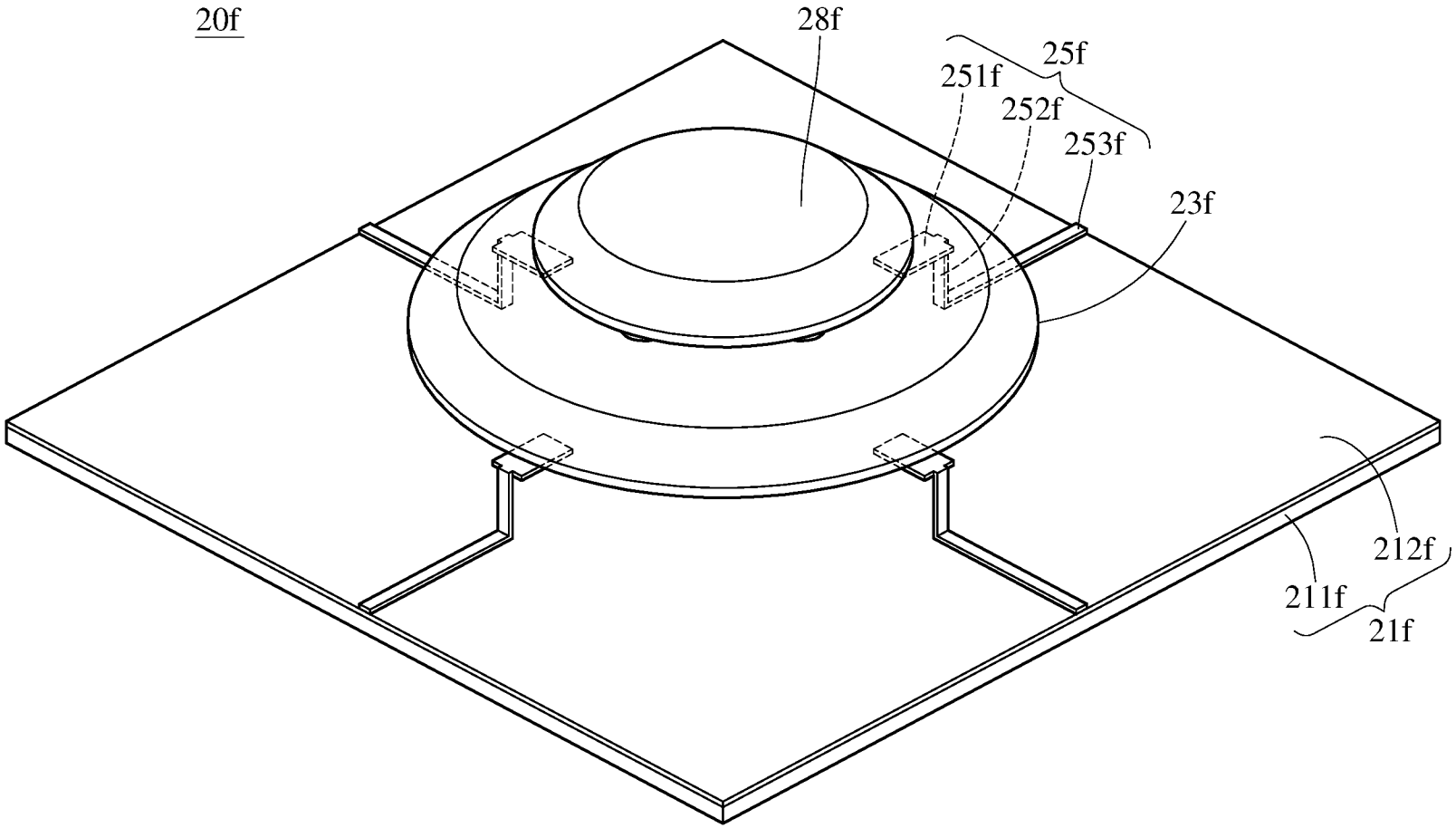
FIG. 17 is a perspective view of the seventeenth embodiment of a polarized antenna in the disclosure.

Other types of second radiation plate in the polarized antenna may be contemplated. Please refer to FIG. 14 to FIG. 17. FIG. 14 is a top view of the fourteenth embodiment of a polarized antenna in the disclosure, FIG. 15 is a top view of the fifteenth embodiment of a polarized antenna in the disclosure, FIG. 16 is a top view of the sixteenth embodiment of a polarized antenna in the disclosure, and FIG. 17 is a perspective view of the seventeenth embodiment of a polarized antenna in the disclosure. In the embodiments shown in FIG. 14 to FIG. 17, the shapes, amount and positions of the load board, the first radiation plate, the feeding parts and the grounded parts can be designed according to a variety of actual requirements. For example, the relative position of the connecting parts 29*c* and the grounded parts 27*c* can be designed as shown in FIG. 14, and the shape of the first radiation plate and the shape of the second radiation plate can be designed as FIG. 15 to FIG. 17; and these embodiments are not limited thereto. In an embodiment, the shapes of the first and second radiation plates are symmetrical shapes, such as round shape, quadrangle, pentagon or hexagon.

Figure 18:
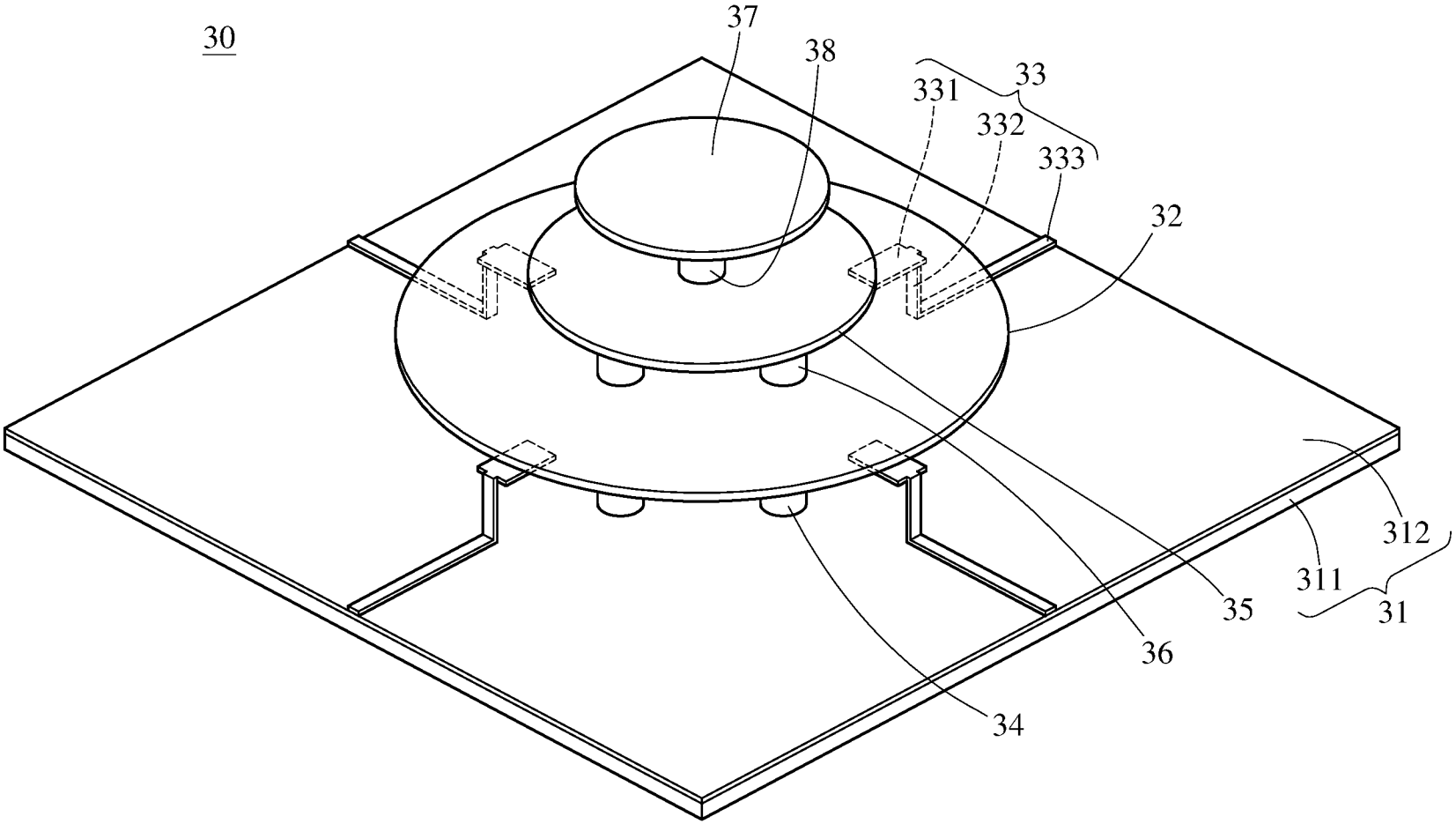
FIG. 18 is a perspective view of the eighteenth embodiment of a polarized antenna in the disclosure.

Please refer to FIG. 18. FIG. 18 is a perspective view of the eighteenth embodiment of a polarized antenna in the disclosure. As shown in FIG. 18, a polarized antenna 30 includes a load board 31, a first radiation plate 32, M pieces of feeding part 33, N pieces of grounded part 34, a second radiation plate 35, P pieces of first connecting part 36, a third radiation plate 37 and R pieces of second connecting part 38, where P and R are positive integers. The load board 31, the first radiation plate 32, the M pieces of feeding part 33 and the N pieces of grounded part 34 could be carried out by the previous embodiments. In this embodiment, the third radiation plate 37 is disposed above the second radiation plate 35 via the support of the second connecting part 38 and has a third resonance gap with the second radiation plate 35. As an example, the amount of the second connecting part 38 is one, and the second connecting part 38 is located at the center of the third radiation plate 37. The material of the second connecting part 38 is, for example, plastic or another suitable insulation material.

In this embodiment, the width of the third resonance gap between the third radiation plate 37 and the second radiation plate 35 is smaller than or substantially equal to the width of the first resonance gap between the first radiation plate 32 and the load board 31, and the disposition of the third radiation plate 37 may enhance the gain value and directivity of the polarized antenna 30.

In summary, the disclosure provides a polarized antenna, in which three or more than three feeding parts are disposed to receive electromagnetic waves in a variety of directions of electric field and two or more than two grounded parts are disposed as an insulation manner to shorten the resonance paths constituted by the feeding parts and the first radiation plate and reduce the interference from the resonant modes of the resonance paths, so as to enhance the receiver insulation.

What is claimed is:

1. A multiple polarized antenna, comprising:

a load board comprising a conductive layer;

a first radiation plate located above the load board and having a first resonance gap with the conductive layer;

M pieces of feeding part located under the first radiation plate and insulated from the conductive layer, at least a part of each of the feeding parts being covered by and located under the first radiation plate, the feeding part configured to have signal transmission with the first radiation plate, wherein M is a positive integer larger than 2; and N pieces of grounded part disposed on the load board and electrically connected to the conductive layer, wherein N is a positive integer larger than 1, wherein each of the feeding parts extends in one corresponding feeding direction and transmits and receives signals in said corresponding feeding direction;

wherein an amount of the feeding part is 4 and an amount of the grounded part is 4, the corresponding feeding directions of two of the four feeding parts are respectively a positive direction and a reverse direction along a first preset axis, and the corresponding feeding directions of the others of the four feeding parts are respectively a positive direction and a reverse direction along a second preset axis;

wherein the four feeding parts include a left, a right, an upper and a lower feeding parts, the left and right feeding parts extend in the positive and the reverse directions of the first preset axis, and the upper and lower feeding parts extend in the positive and reverse directions of the second preset axis; the grounded parts include a first, a second, a third, and a fourth grounded parts, the first grounded part is located in between the positive direction of the first preset axis and the positive direction of the second preset axis; the second grounded part is located in between the positive direction of the first preset axis and the reverse direction of the second preset axis; the third grounded part is located in between the reverse direction of the first preset axis and the reverse direction of the second preset axis; and the fourth grounded part is located in between the reverse direction of the first preset axis and the positive direction of the second preset axis; and wherein each of the feeding parts includes a first conductor section, a second conductor section and a third conductor section, the second conductor section is located between the first conductor section and the third conductor section, and the first conductor section, the second conductor section, and the third conductor section extend along different planes respectively, the first conductor section is inside the edge of the first radiation plate and there is a coupling gap between the first conductor section and the first radiation plate, the load board further comprises a dielectric layer connected with the conductive layer, the third conductor section is outside the edge of the first radiation plate and touches one surface of the dielectric layer.

2. The polarized antenna according to claim 1, wherein the third conductor section touches the load board, the first conductor section is located between the first radiation plate and the load board and is separated from the load board.

3. The polarized antenna according to claim 2, wherein the dielectric layer has a first surface and a second surface opposite to the first surface, and as the conductive layer is located on the first surface of the dielectric layer, the third conductor section is located on the second surface of the dielectric layer.

4. The polarized antenna according to claim 2, wherein at least one of the first, second and third conductor sections is covered by and located under the first radiation plate and is substantially parallel to the first conductor section and the first radiation plate.

5. The polarized antenna according to claim 4, wherein the first conductor section touches the first radiation plate.

6. The polarized antenna according to claim 2, wherein at least a part of the first conductor section is covered by and located under the first radiation plate, and the first conductor section is substantially parallel to the first radiation plate.

7. The polarized antenna according to claim 6, wherein the first conductor section touches the first radiation plate.

8. The polarized antenna according to claim 1, wherein there are M pieces of through hole within the load board, the M pieces of through hole are covered by and located under the first radiation plate, at least a part of each of the feeding parts overlaps one of the through holes, the part of each of the feeding parts overlapping the through hole transmits signals with the first radiation plate through the through hole.

9. The polarized antenna according to claim 1, further comprising:

a second radiation plate located above the first radiation plate and having a second resonance gap with the first radiation plate, and a width of the second resonance gap being smaller than or substantially equal to a width of the first resonance gap.

10. The polarized antenna according to claim 9, further comprising:

a third radiation plate located above the second radiation plate and having a third resonance gap with the second radiation plate, and a width of the third resonance gap being smaller than or substantially equal to the width of the first resonance gap.

11. The polarized antenna according to claim 10, wherein the first radiation plate, the second radiation plate and the third radiation plate have a respective symmetrical shape.

12. The polarized antenna according to claim 9, wherein at least one of the N pieces of grounded part is connected to the first radiation plate and the second radiation plate.

13. The polarized antenna according to claim 9, further comprising:

P pieces of connecting part connected to and located between the first radiation plate and the second radiation plate, wherein P is a positive integer.

14. The polarized antenna according to claim 13, wherein the N pieces of grounded part are separated from the first radiation plate.

15. The polarized antenna according to claim 1, wherein the first preset axis is substantially vertical to the second preset axis.

* * * * *